US005968347A

United States Patent [19]

Kolodziej et al.

[11] Patent Number: 5,968,347

[45] Date of Patent: Oct. 19, 1999

[54] MULTI-STEP HYDRODESULFURIZATION PROCESS

[75] Inventors: Richard Joseph Kolodziej, Naperville, Ill.; George Edwin Harrison, Billericay; Donald Hugh McKinley, Radlett, both of United Kingdom

[73] Assignee: Kvaerner Process Technology Limited, London, United Kingdom

[21] Appl. No.: 08/849,062

[22] PCT Filed: Nov. 23, 1995

[86] PCT No.: PCT/GB95/02731

§ 371 Date: May 23, 1997

§ 102(e) Date: May 23, 1997

[87] PCT Pub. No.: WO96/17903

PCT Pub. Date: Jun. 13, 1996

[30] Foreign Application Priority Data

Nov. 25, 1994 [EP] European Pat. Off. ..... 94308715

[51] Int. Cl.[6] ..... C10G 17/02; C10G 45/04

[52] U.S. Cl. ..... 208/213; 208/210; 208/211; 208/212; 208/216 R; 208/217; 208/222

[58] Field of Search ..... 208/210, 211, 208/212, 213, 216 R, 217, 222

[56] References Cited

U.S. PATENT DOCUMENTS

| | | | |
|---|---|---|---|
| 3,691,152 | 9/1972 | Nelson et al. | 208/210 |
| 3,717,571 | 2/1973 | Schulman . | |
| 3,733,260 | 5/1973 | Davies et al. . | |
| 3,761,399 | 9/1973 | McKinney et al. . | |
| 3,775,305 | 11/1973 | McKinney et al. . | |
| 4,392,945 | 7/1983 | Howard et al. . | |
| 4,801,373 | 1/1989 | Corman et al. . | |
| 4,822,480 | 4/1989 | Harandi et al. . | |
| 4,875,992 | 10/1989 | Hamner . | |
| 5,015,359 | 5/1991 | Harandi et al. . | |
| 5,292,428 | 3/1994 | Harrison et al. | 208/208 R |

FOREIGN PATENT DOCUMENTS

| | | |
|---|---|---|
| 0300018 | 1/1989 | European Pat. Off. . |
| 0474644 | 3/1992 | European Pat. Off. . |
| 0553920 | 8/1993 | European Pat. Off. . |
| 0611816 | 8/1994 | European Pat. Off. . |

*Primary Examiner*—Walter D. Griffin
*Assistant Examiner*—Tam M. Nguyen
*Attorney, Agent, or Firm*—Rothwell, Figg, Ernst & Kurz

[57] ABSTRACT

A hydrotreatment process for effecting hydrotreatment of a liquid hydrocarbon feedstock containing a mixture of liquid hydrocarbons together with organic sulphurous impurities in which a desulphurised liquid first hydrocarbon fraction is contacted with a first stream of desulphurised recycle gas to produce (A) a vaporous mixture including unreacted hydrogen, hydrogen sulphide, and a second hydrocarbon fraction including relatively more volatile components of the mixture of hydrocarbons and (B) a third liquid hydrocarbon fraction including relatively less volatile components of the mixture of hydrocarbons as well as residual sulphurous impurities, the vaporous mixture and the third liquid hydrocarbon fraction being recovered as separate streams from the contact zone. The third liquid hydrocarbon fraction is contacted with a mixture of make-up hydrogen-containing gas and desulphurised recycle gas to cause hydrodesulphurisation of residual sulphurous impurities in the third liquid hydrocarbon fraction. Further processing is followed by recovering a hydrocarbon fraction as a final hydrotreated product material.

15 Claims, 4 Drawing Sheets

MULTI-STEP HYDRODESULFURIZATION PROCESS

FIELD OF THE INVENTION

This invention relates to a process for hydrotreatment of a hydrocarbon feedstock.

BACKGROUND TO THE INVENTION

Crude oils, their straight-run and cracked fractions and other petroleum products contain sulphur in varying amounts, depending upon the source of the crude oil and any subsequent treatment that it may have undergone. Besides elemental sulphur, numerous sulphur compounds have been identified in crude oil including hydrogen sulphide ($H_2S$), $C_1$ to $C_5$ primary alkyl mercaptans, $C_3$ to $C_8$ secondary alkyl mercaptans, $C_4$ to $C_6$ tertiary alkyl mercaptans, cyclic mercaptans (such as cyclopentane thiol, cyclohexane thiol and cis-2-methylcyclopentane thiol), open chain sulphides of the formula R—S—R' where R and R' represent $C_1$ to $C_4$ alkyl groups, mono-, bi- and tri-cyclic sulphides, thiophene, alkyl substituted thiophenes, condensed thiophenes (such as benzo(b)thiophene, isothionaphthene, dibenzothiophene, and benzo(b)naphtho(2,1-d)thiophene), thienothiophenes, alkyl cycloalkyl sulphides, alkyl aryl sulphides, 1-thiaindans, aromatic thiols (such as thiophenol), and cyclic thiols such as cyclohexane thiol.

Most of the sulphur compounds that have been positively identified as components of crude oil boil below about 200° C. Many other sulphur compounds of high molecular weight and high boiling point remain unidentified in crude oil.

For a variety of reasons it is necessary to treat crude oil and petroleum fractions derived therefrom to reduce or remove the sulphur components present therein. Otherwise subsequent processing may be hindered, for example because the sulphur components may adversely affect the performance of a catalyst. If the hydrocarbon fraction is intended for fuel use, then burning of the fuel will result in any sulphur components present therein being converted to sulphur oxides which are environmentally damaging. Moreover the level of particulates in the combustion products of liquid fuels is linked to the sulphur content of the fuel.

For these reasons it is necessary to remove as far as possible the sulphur content from hydrocarbon fractions derived from crude oil, such as gasoline fractions, diesel fuel, gas oils and the like. Typically such sulphur removal is carried out by a process known generally as hydrodesulphurisation. In such a process the hydrocarbon fraction is admixed with hydrogen and passed over a hydrodesulphurisation catalyst under appropriate temperature and pressure conditions. In such a process the aim is to If rupture the carbon-sulphur bonds present in the feedstock and to saturate with hydrogen the resulting free valencies or olefinic double bonds formed in such a cleavage step. In this process the aim is to convert as much as possible of the organic sulphur content to hydrocarbons and to $H_2S$.

Generally the cyclic sulphur-containing compounds are harder to hydrogenate than the open chain compounds and, within the class of cyclic sulphur-containing compounds, the greater the number of rings that are present the greater is the difficulty in cleaving the carbon-sulphur bonds. The presence of alkyl or other substituent groups on the basic ring system can further reduce the reactivity of the organic sulphur compounds towards hydrodesulphurisation.

The specification for Swedish Class I diesel fuel, which is required for use in urban areas, stipulates a maximum aromatics content of 5 volume % and a maximum sulphur content of 10 ppm, while the corresponding specification for Class II diesel fuel limits the aromatics to 20 volume % and sulphur to a maximum of 50 ppm; Class III diesel fuel has a 25 volume % limit on aromatics and a maximum of 500 ppm of sulphur.

When a hydrocarbon feedstock is treated with hydrogen in the presence of a suitable catalyst with the aim of effecting hydrodesulphurisation, other reactions may also occur. Hence hydrotreatment is often used as a more general term to embrace not only the hydrodesulphurisation reactions but also the other reactions including hydrocracking, hydrogenation and other hydrogenolysis reactions, such as hydrodenitrogenation (HDN), hydrodeoxygenation (HDO), and hydrodemetallation (HDM).

There are four main hydrogenolysis reactions, hydrodesulphurisation (HDS), hydrodenitrogenation (HDN), hydrodeoxygenation (HDO), and hydrodemetallation (HDM). Amongst catalysts which have been proposed for such hydrotreating reactions are molybdenum disulphide, tungsten sulphide, sulphided nickel-molybdate catalysts ($NiMoS_x$), and cobalt-molybdenum sulphide supported on alumina (Co—Mo/alumina).

It was generally considered that the simultaneous occurrence of some hydrogenation reactions, such as the facile hydrogenation of olefins and the more difficult hydrogenation of aromatic hydrocarbons, was not advantageous in a hydrotreatment process because the use of valuable hydrogen beyond the point at which the product meets the required specification incurs unnecessary cost. However, the present and future specifications for liquid fuel products will require that future processes will have to provide, amongst other things, liquid fuels and refinery intermediate streams containing substantially lower organic sulphur, organic nitrogen and aromatics contents than have been acceptable in the past. Therefore processes which facilitate these further hydrogenation reactions are becoming increasingly important.

There is a historical trend towards the use of heavier crude oils in refining. Hence the production of higher quality products and refinery intermediate streams from less suitable raw materials requires improved processes. These include residue hydrocracking and catalytic cracking to effect a reduction in the molecular weight of the feed, as well as hydrotreating in order to remove organic sulphur and nitrogen compounds, along with hydrogenation to reduce the aromatics content. Hence, under current conditions and increasingly for the future, it will be desirable to combine hydrodesulphurisation and hydrodenitrogenation with aromatic hydrogenation in advanced hydrotreating processes.

In contrast, except when processing high molecular weight residues, extensive hydrocracking reactions are to be avoided in most refinery hydrotreating operations as far as possible because they are highly exothermic and can cause thermal damage to catalysts and reaction vessels, as well as leading to the deposition of carbonaceous materials causing :,loss of catalyst activity. Thus an operator of a hydrodesulphurisation plant has reported in an article "Refiners seek improved hydrogen production", Oil & Gas Journal, Jul. 20, 1987, pages 48 and 49, that reactors in service have overheated severely, one to the point of rupture, due to unwanted hydrocracking reactions occurring.

The danger of such hydrocracking reactions occurring can be minimised by ensuring that the catalyst remains adequately sulphided during use.

A number of papers have appeared in the literature relating to hydrodesulphurisation technology, including:

(a) "Kinetics of Thiophene Hydrogenolysis on a Cobalt Molybdate Catalyst", by Charles N. Satterfield et al, AIChE Journal, Vol. 14, No. 1 (January 1968), pages 159 to 164;

(b) "Hydrogenation of Aromatic Hydrocarbons Catalysed by Sulfided CoO—$MoO_3$/gamma-$Al_2O_3$. Reactivities and Reaction Networks" by Ajit V. Sapre et al, Ind. Eng. Chem. Process Des. Dev, Vol. 20, No. 1, 1981, pages 68 to 73;

(c) "Hydrogenation of Biphenyl Catalyzed by Sulfided CoO—$MoO_3$/gamma-$Al_2O_3$. The Reaction Kinetics", by Ajit V. Sapre et al, Ind. Eng. Chem. Process Des. Dev, Vol. 21, No. 1, 1982, pages 86 to 94;

(d) "Hydrogenolysis and Hydrogenation of Dibenzothiophene Catalyzed by Sulfided CoO—$MoO_3$/gamma-$Al_2O_3$: The Reaction Kinetics" by D. H. Broderick et al, AIChE Journal, Vol. 27, No. 4, July 1981, pages 663 to 672; and (e) "Hydrogenation of Aromatic Compounds Catalyzed by Sulfided CoO—$MoO_3$/gamma-$Al_2O_3$" by D. H. Broderick et al, Journal of Catalysis, Vol. 73, 1982, pages 45 to 49.

A review of the reactivity of hydrogen in sulphided catalysts, such as those used as hydrotreating catalysts, appears on pages 584 to 607 of the book "Hydrogen Effects of Catalysis" by Richard B. Moyes, published by Marcel Dekker, Inc. (1988).

A review of industrially practised hydrotreating processes is published each year in the Journal "Hydrocarbon Processing". For example reference may be made to "Hydrocarbon Processing", November 1990, page 112 et seq and to "Hydrocarbon Processing", November 1992, page 178 et seq.

An outline of three prior art hydrotreating processes appears in "Hydrocarbon Processing 1988 Refining Handbook" on pages 78 and 79 of "Hydrocarbon Processing", September 1988. In the "Chevron RDS/VRDS Hydrotreating Process" a mixture of fresh liquid hydrocarbon feedstock, make-up hydrogen and recycled hydrogen is fed to a reactor in a "once-through" operation for the liquid feed. As illustrated the reactor has three beds and inter-bed cooling is provided by injection of further amounts of recycle hydrogen. The recycle hydrogen is passed through an $H_2S$ scrubber. In the "HYVAHL Process" a once-through operation for the liquid feed is also used. Again, amine scrubbing is used to remove $H_2S$ from the recycle hydrogen. The "Unionfining Process" also utilises a once-through basis for the liquid feed. Co-current hydrogen and liquid flow is envisaged. Unreacted hydrogen is partially recycled.

In all three processes gas recycle is used to cool the catalyst bed and so minimise the risk of thermal runaways occurring as a result of significant amounts of hydrocracking taking place. Use of gas recycle means that inert gases, that is to say gases other than hydrogen, tend to accumulate in the circulating gas which in turn means that, in order to maintain the desired hydrogen partial pressure, the overall operating pressure must be raised to accommodate the circulating inert gases and that the size and cost of the gas recycle compressor must be increased and increased operating costs must be tolerated.

In an article entitled "Reduction of aromatics in diesel" which appeared in "Hydrocarbon Technology International 1994", edited by Peter Harrison, published by Sterling Publications Limited, B. H. Cooper et al describe a dual-stage process developed by Haldor Topsφe for low-aromatics diesel production which involves initial hydrotreating using a high activity base-metal catalyst, such as a high activity NiMo catalyst, intermediate stripping of the cold hydrotreated intermediate product to remove $H_2S$ and $NH_3$, followed by a second stage of aromatics hydrogenation using a sulphur-tolerant noble-metal catalyst, and product stripping. Further information concerning this process are to be found in an article entitled "Diesel aromatics saturation, a comparative study of four catalyst systems" by B. P. Cooper et al, ACS Preprints, Div. of Fuel Chemistry, Vol. 37, No. 1, 1992, pages 41 to 49, and in a paper presented to the National Petroleum Refiners Association at the 1992 NPRA Annual Meeting, Mar. 22–24, 1992, Marriott/Sheraton, New Orleans, La., U.S.A. with the title "Topsφe's process for improving diesel quality", AM-92-50, by Peter Sφgaard-Andersen et al.

Hydrorefining of a naphtha feedstock is described in U.S. Pat. No. 4,243,519. This appears to involve a substantially wholly vapour phase process using two hydrorefining stages. A sulphur-containing naphtha feedstock is mixed with the gas from the second hydrorefining stage and passed to the first hydrorefining stage. The first hydrorefining stage is followed by a separation stage in which a gaseous phase containing a major portion of the hydrogen sulphide formed in the first hydrorefining stage is separated from a partially desulphurised naphtha which is mixed with fresh hydrogen before passing to the second hydrorefining stage.

Multiple stage hydrodesulphurisation of residuum with movement of catalyst between stages in the opposite direction to movement of gas and liquid is described in U.S. Pat. No. 3,809,644.

U.S. Pat. No. 3,847,799 describes conversion of black oil to low-sulphur fuel oil in two reactors. Make-up hydrogen is supplied to the second reactor but in admixture with hydrogen exiting the first reactor that has been purified by removal of hydrogen sulphide therefrom. Hence hydrogen is recovered from the first reactor and recycled to the second reactor in admixture with inert gases which will accordingly tend to accumulate in the gas recycle loop. Any condensate obtained from the first reactor is admixed with product from the second reactor.

Hydrorefining of a heavy hydrocarbonaceous oil containing certain types of sulphur compounds such as dibenzothiophenes, in two stages with interstage removal of hydrogen sulphide and ammonia is described in U.S. Pat. No. 4,392,945. A nickel catalyst is used in the first stage and a cobalt catalyst in the second stage. A further example of a multistage hydrodesulphurisation process in which hydrogen sulphide and ammonia are removed between stages is described in U.S. Pat. No. 3,717,571.

In U.S. Pat. No. 4,048,060 there is disclosed a two-stage hydrodesulphurisation process with optional removal of hydrogen sulphide from the hydrotreated product between stages. This proposal utilises a first stage catalyst and a second stage catalyst which comprise Group VIB and Group VIII metal components. The second stage catalyst has a narrow and critical range of pore size distribution and relatively larger pores than the first stage catalyst. The hydrogen-containing treating gas is recycled to the hydrotreating zones, usually after removal of hydrogen sulphide.

U.S. Pat. No. 4,051,020 describes countercurrent passage of a hydrocarbon oil to be desulphurised and hydrogen through a reaction vessel with catalyst particles moving from stage to stage in the reactor concurrently with either the liquid phase or the gas phase.

In FR-A-2014517 a sulphur-containing oil is mixed with a hydrogen-rich gas, heated in a furnace and then passed upwardly through a reactor containing a catalyst supported on a grill.

U.S. Pat. No. 3,425,810 illustrates a multi-tray hydrotreating apparatus with provision for counter-current flow of oil and hydrogen.

In U.S. Pat. No. 3,519,557 there is taught a process for hydrogenating hydrocarbon feedstocks using three reactors in series, with flash towers following each stage, the flashed liquid stream from the first reactor forming the feed stream to the second reactor, and that from the second reactor forming the feed to the third reactor. According to this proposal the first reactor is fed with fresh make-up gas and the second and third reactors with a mixture of fresh make-up gas and recycle high purity hydrogen. Flashing is effected by suddenly reducing the pressure in each flash tower. According to column 4 lines 7 to 11 liquids from Stage 2 are charged with make-up hydrogen to Stage 3; however, according to column 4 lines 16 to 18 hydrogen from flashing tower 3 and from the hydrogen scrubber 4 are returned to reactors 2 and 3 by means of compressor 6. No provision is made for controlling the level of inert gases in the recycle hydrogen; presumably such inert gases leave the plant dissolved in the product from product fractionator 5.

U.S. Pat. No. 3,900,390 discloses hydroprocessing of hydrocarbon charges in two moving bed reactors, the first of which is fed with a mixture of feedstock and recycle hydrogen. The catalyst-containing mixture emerging from the bottom of the first reactor passes to a separator from which the gas phase and light hydrocarbons are taken to a condenser. The light hydrocarbons are recovered while the gas phase is scrubbed with an amine and admixed with fresh hydrogen for admission to the second moving bed reactor along with the liquid phase and catalyst from the separator.

A hydrofining-reforming process in which a sulphur-containing hydrocarbon feedstock is given a two stage hydrofining treatment is described in U.S. Pat. No. 3,884,797. A feed naphtha is mixed with recycle and make-up hydrogen and fed to the first hydrofining reactor. The effluent is cooled and washed with water to remove ammonia and a substantial proportion of the hydrogen sulphide. After separation from the gas stream the condensate is then flashed into a low pressure separator from which a mixture of $C_1$ to $C_3$ hydrocarbons is recovered. The flashed condensate is then stripped with make-up hydrogen, the stripping gas being passed to the first hydrofining reactor. The stripped condensate passes on to a hydrosorbing stage and then to catalytic reforming.

A hydrocracking process with pre-hydrofining that uses a gas oil feedstock is described in U.S. Pat. No. 3,364,133. The flow sheet for this process is somewhat similar to that of U.S. Pat. No. 3,884,797.

Another plant with a somewhat similar flow sheet for converting hydrocarbonaceous black oils into lower boiling hydrocarbons using hydrodesulphurisation catalysts is described in U.S. Pat. No. 4,159,935.

WO-A-92/16601 describes a process for producing diesel fuel from a diesel hydrocarbon feed which is fed concurrently with hydrogen to a first hydrogenation zone from which there is recovered a liquid effluent. That liquid effluent is then passed to a second hydrogenation zone in which it is contacted countercurrently with hydrogen. A similar proposal appears in FR-A-2151059.

In U.S. Pat. No. 2,952,626 it is proposed to hydrofine a gas oil feed in a first stage under mixed vapour and liquid phase conditions, using co-current flow with a mixture of recycle gas and make-up hydrogen, and then to subject the liquid phase in countercurrent flow with hydrogen in a second stage.

GB-A-901332 proposes using two stage catalytic pressure refining of hydrocarbon fractions wherein a refining gas which contains less than 60 a by volume of hydrogen, such as a coke oven gas, is used in the first stage while practically pure hydrogen is used in the second stage. The Examples describe treatment of a light oil obtained by gasification of crude petroleum and treatment of a crude benzene.

A multi-stage hydrodesulphurisation process using unusually high space velocities and inter-stage removal of $H_2S$ is described in U.S. Pat. No. 3,349,027.

U.S. Pat. No. 4,016,069 teaches a multiple stage process for hydrodesulphurising a residual oil comprising passing the oil downwardly through a plurality of stages in series with an interstage flashing step. A portion of the fresh feed oil continuously or intermittently bypasses the first stage and flows directly to the second stage. The first stage is fed with recycle hydrogen and the second stage with a mixture of make-up and recycle hydrogen.

Hydrotreating of pyrolysis gasoline is the subject of U.S. Pat. No. 3,492,220. The feedstock is treated in three reactors connected in series with a mixture of recycle gas and make-up hydrogen.

Hydrodenitrogenation of oil with countercurrent hydrogen is disclosed in U.S. Pat. No. 3,268,438. A mixture of recycle hydrogen and make-up hydrogen is used in each of two reaction zones.

U.S. Pat. No. 3,256,178 teaches a hydrocracking process in which limited catalytic hydrofining to remove most of the organic nitrogen impurities using a mixture of recycle gas and make-up gas is followed by a hydrocracking stage in which the liquid flows downwardly against an upflowing stream of initially ammonia-free hydrogen. A related process using a similar flow arrangement is described in U.S. Pat. No. 3,147,120.

In U.S. Pat. No. 3,132,089 there is described a hydrocracking process in which gas oil is passed, together with a mixture of recycle gas and make-up gas through a hydrofining zone, followed by low temperature hydrogenation and then by low temperature hydrocracking.

Hydrorefining of a heavy hydrocarbon oil containing asphaltenes and metallic, nitrogenous and sulphurous contaminants is taught in U.S. Pat. No. 3,180,820. According to this proposal a mixture of the oil, make-up hydrogen and recycle gas is reacted in the presence of a solid hydrogenation catalyst in a first stage to convert asphaltenes and metallic constituents and then at least the higher boiling fraction of the hydrocarbonaceous effluent is further treated in a second hydrorefining zone.

CA-A-749332 teaches hydrorefining of sulphur-containing hydrocarbon distillates in two zones in series. The feed is mixed with a mixture of recycle gas and make-up hydrogen and passed through the two zones in turn.

Other patent specifications that describe hydrodesulphurisation of hydrocarbon feedstock include FR-A-2357635 and BE-A-571792.

WO-A-89/05286 describes favourable flow conditions for effecting hydrogenation reactions, including hydrodesulphurisation.

In a conventional hydrodesulphurisation plant the hydrogen sulphide generated in any part of a catalyst bed proceeds through the entire remainder of the bed to emerge in the gas and liquid phases issuing from that bed. This is the case even in plants with multiple beds in which interbed cooling with "cold shots" of recycle gas to limit the temperature rises due to the exothermic reactions is practised. Injection of "cold shots" between beds of catalyst has the merit of reducing the $H_2S$ partial pressure somewhat by dilution, provided that the injected gas of the "cold shot" has a low $H_2S$ content or is $H_2S$-free. However, this injection procedure does have the disadvantage that the residence time of the vaporised hydrocarbons, and to some extent that of any liquid phase present, is reduced by this practice. In addition the $H_2S$ partial pressure is highest at the exit end of the hydrotreating reactor. Since it is known that a high partial pressure of $H_2S$ inhibits the hydrodesulphurisation and aromatic hydrogenation reactions, the catalyst activity is lowest at the exit end from the bed where the hydrogen partial pressure is also lowest and so the result is that the least reactive organic sulphur compounds, which are the sulphur compounds that will survive to the exit end of the catalyst bed, have to be treated here under the most adverse conditions prevailing in the catalyst bed. As a consequence such unreactive sulphur compounds can consequently remain unreacted and can emerge in the product oil.

The catalysts used for hydrodesulphurisation are usually also capable of effecting some hydrogenation of aromatic compounds, provided that the hydrogen sulphide level is low. The conditions required for carrying cut hydrogenation of aromatic compounds are generally similar to these required for hydrodesulphurisation although, unlike hydrodesulphurisation, aromatic hydrogenation is an equilibrium limited reaction, the equilibrium position being adversely affected by high temperatures and low hydrogen partial pressures. The inhibition of aromatics hydrogenation by hydrogen sulphide is demonstrated and discussed in the paper by Ajit V. Sapre cited above. However, as the reaction is an equilibrium that is not favoured by use of high temperatures, the conditions required for hydrodesulphurisation of cyclic and polycyclic organic sulphur compounds in a conventional plant do not favour hydrogenation of aromatic compounds. Moreover as the design of conventional hydrodesulphurisation plants results in relatively high partial pressures of $H_2S$, in relatively low partial pressures of hydrogen, in relatively high partial pressures of any inert gases present, and in high temperatures, at the downstream end of the plant the catalyst activity is correspondingly reduced and the conditions do not lead to significant reduction in the aromatic content of the feedstock being treated. Hence in an article entitled "Panel gives hydrotreating guides", Hydrocarbon Processing, March 1989, pages 113 to 116, it is staged at page 114:

"It is a fundamental kinetic fact that at pressures for normal middle distillate desulfurizers (500 to 800 psig) it is difficult to obtain appreciable aromatic saturation. Thus, if the feedstock is far above the 20% aromatics level, there is not much you can do with typical hydrotreaters, with any catalysts that we have knowledge of, to significantly reduce aromatics.

You are then left with the unpalatable alternatives of higher pressure units, aromatic extraction, and all the other alternatives."

Removal of $H_2S$ from a hydrodesulphurisation plant with a gas recycle system is normally effected by scrubbing the recycle gas with an amine. As the scrubber section has to be sufficiently large to cope with the highest levels of sulphurous impurities likely to be present in the feedstocks to be treated, the scrubber equipment has to be designed with an appropriate capacity, even though the plant will often be operated with lower sulphur feedstocks. The capital cost of such scrubber equipment is significant.

A multi-stage hydrodesulphurisation process is described in WO-A-90/13617 and WO-A-92/08772 in which the feedstock to be desulphurised is passed through a plurality of hydrodesulphurisation zones in series, each containing a charge of a hydrodesulphurisation catalyst. In each zone the feedstock flows in co-current with hydrogen. The hydrogen-containing gas feed to the first zone is gas recovered from another zone. Usually the make-up hydrogen-containing gas is supplied to the final zone. A purge gas stream is taken from the first zone and is subjected to an amine wash to recover $H_2S$ therefrom. Provision is made for supplying $H_2S$, $CH_3SH$ or the like to the first zone to ensure that the catalyst remains sufficiently sulphided.

In WO-A-90/13612 and WO-A-92/08771 there is described a hydrodesulphurisation process in which the feedstock is allowed to trickle down from tray to tray through a column reactor fitted with reaction trays, each containing a charge of a catalyst dispersed in the liquid on the tray, against an upflowing current of a hydrogen-containing gas.

SUMMARY OF THE INVENTION

It would be desirable to provide a more efficient process for effecting hydrotreatment of liquid hydrocarbon feedstocks. It would also be desirable to provide a hydrotreatment process which permits operation in such a way as to achieve a simultaneous significant reduction in the aromatics content of the feedstock being treated, particularly those feedstocks in which the aromatics content exceeds about 20%.

The invention accordingly seeks to provide a process in which hydrotreatment can be conducted more efficiently than in a conventional hydrotreatment process. It further seeks to provide a hydrotreatment process which enables also a significant reduction in the aromatics content of the feedstock to be effected simultaneously with hydrodesulphurisation. It also seeks to provide a hydrotreatment process in which hydrodenitrogenation can occur efficiently at the same time as hydrodesulphurisation.

According to the present invention there is provided a hydrotreatment process for effecting hydrotreatment of a liquid hydrocarbon feedstock containing a mixture of liquid hydrocarbons together with organic sulphurous impurities which comprises:

(a) providing first-and second hydrotreatment zones each containing a charge of a sulphided hydrotreatment catalyst;

(b) supplying to the first hydrotreatment zone the hydrocarbon feedstock and a hydrogen-containing gas;

(c) maintaining the first hydrotreatment zone under hydrotreatment conditions effective for causing hydrodesulphurisation of organic sulphurous impurities in the hydrocarbon feedstock;

(d) recovering from the first hydrotreatment zone a first intermediate product stream comprising unreacted hydrogen, hydrogen sulphide, and a mixture of hydrocarbons including a liquid first hydrocarbon fraction;

(e) contacting the liquid first hydrocarbon fraction with a first stream of desulphurised recycle gas thereby to yield (A) a vaporous mixture comprising unreacted hydrogen, hydrogen sulphide, and a second hydrocarbon fraction comprising relatively more volatile components of the mixture of hydrocarbons and (B) a third liquid hydrocarbon fraction comprising relatively less volatile components of the mixture of hydrocarbons as well as residual sulphurous impurities;

(f) supplying to the second hydrotreatment zone material of the third liquid hydrocarbon fraction of step (e) and a mixture of make-up hydrogen-containing gas and desulphurised recycle gas;

(g) maintaining the second hydrotreatment zone under hydrotreatment conditions effective for causing hydrodesulphurisation of residual sulphurous impurities in the third liquid hydrocarbon fraction;

(h) recovering from the second hydrotreatment zone a second intermediate product stream comprising unreacted hydrogen, hydrogen sulphide and a desulphurised mixture of hydrocarbons;

(i) cooling material of the vaporous mixture of step (e) to effect condensation of material of the second hydrocarbon fraction;

(j) subjecting unreacted hydrogen present in the vaporous mixture of step (e) to $H_2S$ removal to form a desulphurised hydrogen-containing gas;

(k) supplying desulphurised gas of step (j) as desulphurised recycle gas to steps (e) and (f);

(l) separating from the second intermediate product stream of step (h) (A) a fourth desulphurised hydrocarbon fraction and (B) a gas stream containing unreacted hydrogen and hydrogen sulphide;

(m) supplying material of the gas stream of step (l) as hydrogen-containing gas to step (b); and (n) recovering as a final hydrotreated product material of at least one fraction selected from the second hydrocarbon fraction and the fourth hydrocarbon fraction.

In the process of the invention the gas supplied to the first hydrotreatment zone comprises $H_2S$-containing gas from the second hydrotreatment zone, while the gas supplied to the second hydrotreatment zone comprises a mixture of make-up hydrogen-containing gas and desulphurised gas recycled from the first hydrotreatment zone, as well as gas dissolved in the third liquid hydrocarbon fraction of step (e). This recycled gas may comprise significant quantities of inert gases whose presence in the make-up gas is a result of normal refining practice. Thus hydrogen generated by oil refinery operations, e.g. catalytic reforming of hydrocarbons, may contain, for example, from about 10% to about 30% inert gas and can be used in the hydrotreatment process of the invention, as can also hydrogen generated by the steam reforming of methane containing, for example, about 5% inert gases. Although the level of inert gases in the circulating gas can be controlled by purging part of the recirculating gas, nevertheless it may become uneconomic to operate with a circulating gas stream that contains less than about 25 volt % of inert gases and it can happen that the level of inert gases can be allowed to accumulate to as high as about 50 volt %. Another source of inert gases in the circulating gas can be hydrocracking reactions in the hydrotreatment zones. This can occur particularly when the feedstock is relatively heavy. In such hydrocracking reactions side chains of aromatic compounds are removed by hydrodealkylation reactions forming, for example, methane, ethane and propane, which accumulate in the gas phase and lower the hydrogen partial pressure therein.

In step (e) of the process of the invention the liquid first hydrocarbon fraction is stripped by contact with a first stream of recycled gas. As specified in step (k) of the process of the invention, this first stream of recycled gas comprises part of the desulphurised gas of step (j). Another part of the desulphurised gas of step (j) is supplied to step (f) of the process of the invention for admixture with make-up hydrogen-containing gas. As explained further below, the gas used in steps (e) and (f) of the process of the invention may be substantially sulphur-free, in which case the gas will have all passed through a scrubber stage for the removal of $H_2S$ therefrom. Scrubbing with an aqueous amine solution is a suitable method of $H_2S$ removal. Alternatively the gas used in steps (e) and (f) of the present invention may be only partially desulphurised. For example, part of the gas may bypass the scrubber stage and be remixed with the gas that has passed through the scrubbers so as to provide a gas stream for recycle that has a predetermined low sulphur content.

The effect of the stripping step (e) is that unreacted hydrogen from the first hydrotreatment zone and inert gases present in the gas supplied to the first hydrotreatment zone will be in the vaporous mixture of step (e). This vaporous mixture will also contain $H_2S$ and $NH_3$ produced as a result of hydrodesulphurisation and hydrodenitrogenation in the first hydrotreatment zone. Gaseous components in the vaporous mixture of step (e) remaining after condensation in step (i) are subjected to $H_2S$ removal in step (j), prior to admixture of at least a part of these gaseous components with the make-up gas stream. The resulting mixed gas stream is supplied to the second hydrotreatment zone in the process of the invention. Hence the gas stream supplied to the second hydrotreatment zone has the highest hydrogen partial pressure in the hydrotreatment plant.

In step (j) unreacted hydrogen present in the vaporous mixture of step (e) is subjected to $H_2S$ removal to form a desulphurised hydrogen-containing gas. Such $H_2S$ removal can be effected in conventional manner, for example, by washing the gas stream of step (j) with an amine solution. Typical amines which can be used for this purpose include monoethanolamine, diethanolamine, triethanolamine, and the like.

Since the vaporous mixture of step (e) contains most of the more volatile hydrocarbons present in the feedstock, the volume of the third liquid hydrocarbon fraction of step (e) is less than the corresponding volume of feedstock. This means that the residence time in contact with a given volume of catalyst in the second hydrotreatment zone is increased in comparison to the corresponding residence time in contact with an identical volume of catalyst in the first hydrotreatment zone. Moreover, because the vapour pressure of the third liquid hydrocarbon fraction is reduced, in comparison to that of the feedstock, the partial pressure of hydrogen is further enhanced in the second hydrotreatment zone. It should be noted that under otherwise similar conditions catalyst life is longer at higher hydrogen partial pressure, and shorter at higher temperatures; therefore the process of the invention provides further advantages that can be realised in terms of a combination of higher operating temperature and longer catalyst life in the second hydrotreatment zone. Since the feed to the second hydrotreatment zone is already partially desulphurised, the $H_2$ consumption and the heat released in the second hydrotreatment zone are lower than in the first hydrotreatment zone. Thus the temperature rise and hydrogen consumption across the second hydrotreatment zone can readily be kept within acceptable limits.

The third liquid hydrocarbon fraction of step (e) has a low hydrogen sulphide content, that is to say it contains less than about 40%, preferably less than about 25%, and even more preferably less than about 20%, of the hydrogen sulphide present in the first intermediate product of step (d). Stripping in step (e) is carried out under controlled temperature and pressure conditions. Such controlled temperature and pressure conditions are preferably selected so as to minimise the amount of hydrogen sulphide passed forward in material of the third liquid hydrocarbon fraction to the second hydrotreatment zone in step (f) of the process of the invention. Preferably stripping is carried out substantially at the exit pressure from the first hydrotreatment zone. Alternatively it can be effected at a pressure higher than or lower than that exit pressure; normally the pressure at which stripping takes place will not be more than about 10 psi (about 0.69 bar), and preferably not more than about 5 psi (about 0.34 bar), above or below that exit pressure. Stripping at or below that exit pressure is most convenient since it is not necessary to utilise a pump and/or compressor to increase the pressure at which the stripping step takes place. The stripping step is usually carried out at a temperature below the exit temperature from the first hydrotreatment zone. The temperature at which stripping takes place will not usually be more than about 25° C. below the exit temperature from the first hydrotreatment zone.

It is possible to carry out stripping in step (e) of the process of the invention with recycled gas under conditions which allow natural evaporation of volatile materials in the liquid first hydrocarbon fraction. Alternatively stripping can be carried out under conditions of reflux. In this case a liquid hydrocarbon fraction, conveniently part of the third liquid hydrocarbon fraction, is supplied as reflux stream to the stripping step (e). Such a reflux stream will effect a further separation of the less volatile, and less reactive sulphur compounds into the third liquid hydrocarbon fraction of step (e).

The solid sulphided catalyst used in the process of the present invention is preferably selected from molybdenum disulphide, tungsten sulphide, cobalt sulphide, sulphided nickel/tungsten sulphide, cobalt/tungsten sulphide, sulphided nickel-molybdate catalysts ($NiMoS_x$), a sulphided $CoO—MoO_3$/gamma-$Al_2O_3$ catalyst, a sulphided $NiO—MoO_3$/gamma-$Al_2O_3$ catalyst and mixtures thereof. Also very suitable for use in the process of the invention, particularly in the second hydrotreatment zone, is a sulphided platinum/palladium/zeolite catalyst of the type disclosed in U.S. Pat. No. 5,147,526.

Typical hydrotreatment conditions include use of a pressure in the range of from about 15 bar to about 200 bar and of a temperature in the range of from about 220° C. to about 420° C. Preferred conditions include use of a pressure of from about 20 bar to about 150 bar and of a temperature of from about 230° C. to about 400° C. Normally the hydrotreatment conditions are preferably selected so that a part only of the feedstock is in the vapour phase.

In the process of the invention the temperature and pressure conditions used in the second hydrotreatment may be the same as, or different from, the temperature and pressure conditions used in the first hydrotreatment zone. Often, however, it will be preferred to use a higher temperature and/or a higher pressure in the second hydrotreatment zone than in the first hydrotreatment zone. The residence time in the second hydrotreatment zone may be longer than, equal to, or shorter than, that in the first hydrotreatment zone.

The stripping conditions of step (e) will normally be selected to ensure that the sulphur content of the vaporous stream of step (e) is predominantly in the form of $H_2S$ and that any residual sulphurous impurities, which will be predominantly higher boiling cyclic or polycyclic organic sulphurous impurities, largely remain in the third liquid hydrocarbon fraction. Any thiols, sulphides, or disulphides originally present in the hydrocarbon feedstock will generally have undergone hydrodesulphurisation and their sulphur content will have been converted to $H_2S$ in passage through the first hydrotreatment zone. The first intermediate product stream is cooled somewhat prior to effecting stripping step (e). The pressure used in stripping step (e) is normally substantially equal to the exit pressure from the first hydrotreatment zone. However, if the inlet pressure to the second hydrotreatment zone is lower than the exit pressure from the first hydrotreatment zone, then stripping can be carried out at the inlet pressure to the second hydrotreatment zone or at a pressure intermediate between these two pressures. The pressure should be selected so as to enable the desired stripping to be carried out in step (e). If the second hydrotreatment zone is operated at a higher pressure than the first hydrotreatment zone then the required pressure can be achieved in the second hydrotreatment zone by pumping the third liquid hydrocarbon fraction of step (e) to the desired pressure.

The liquid hydrocarbon feedstock comprises a mixture of hydrocarbons at least some of which have a significant vapour pressure at the temperature used in the stripping step (e) of the process of the invention. The hydrocarbons in the feedstock can have a more or less extended range of boiling points at atmospheric pressure of from a few tens of ° C. to several hundreds of ° C.

The liquid sulphur-containing hydrocarbon feedstock may be an oil refinery fraction, for example, a naphtha fraction, a kerosene fraction, a middle distillate fraction, a gas oil fraction, a vacuum gas oil fraction, a lube oil brightstock, a light cycle ol feedstock, a catalytic cracker feedstock, a fuel oil, or a mixture of two or more thereof. Desalted and stabilised crude oils can also be treated by the process of the invention. The feedstock may comprise a mixture of saturated hydrocarbons, such as n-paraffins, iso-paraffins, and naphthenes, in varying proportions. Additionally olefinic hydrocarbons, including mono-olefins, dienes, and trienes, may be present, particularly if the feedstock is at least partially derived from cracked products, such as products from fluid catalytic cracking or residual oil coking operations. It may further comprise one or more aromatic hydrocarbons in amounts of, for example, from about 1 volume % up to about 70 volume % or more. If the feedstock has a low content of aromatic hydrocarbons, then hydrodesulphurisation will be the predominant reaction occurring. However, if the feedstock has an appreciable content of aromatic hydrocarbons, then at least some hydrogenation of these to partially or wholly saturated hydrocarbons may also occur concurrently with hydrodesulphurisation, as well as substantially complete hydrogenation of any olefinic materials present. In this case the hydrogen consumption will be correspondingly increased. The extent of such hydrogenation of aromatic hydrocarbons will be influenced by the choice of reaction conditions and so the degree of dearomatisation of the feedstock that is achieved can be affected by the reaction conditions selected. If the feedstock contains nitrogen-containing materials, then at least some hydrodenitrogenation may also occur.

In the process of the invention the stoichiometric hydrogen demand may thus be a function not only of the sulphur content of the feedstock but also of the aromatics, olefin and nitrogen content thereof. The actual hydrogen consumption will be a function of the operating temperature(s), operating pressure(s) and residence times chosen for use in the first and second hydrotreatment zones, as well as of the ratio of the volume of the third liquid hydrocarbon fraction of step (e) to the volume of the feedstock. The higher the temperature is to which the hydrocarbon feedstock is subjected during hydrotreatment at a given partial pressure of hydrogen at a given residence time, the closer will be the extent to which aromatics hydrogenation (or dearomatisation) occurs compared to that corresponding to the theoretical equilibrium dearomatisation product concentration achievable.

It will thus be appreciated by those skilled in the art that the amount of hydrogen consumed by the process of the invention does not depend solely upon the nature of the feedstock but also upon the severity of the reaction conditions used.

If the feedstock is, for example, a diesel fuel feedstock then the reaction conditions used in the process of the invention will typically be chosen to reduce the residual sulphur content of the final product of step (l) to about 0.05 wt % S or less (i.e. about 500 ppm S or less), e.g. about 0.03 wt % S or less, even down to about 0.005 wt % S or less and to reduce the aromatics content to about 27 volume % or lower, e.g. to about 20 volume % or less.

In the process of the invention there will be used an amount of make up hydrogen which is equivalent to at least the stoichiometric amount of hydrogen required to desulphurise the feedstock and to achieve the desired degree of dearomatisation. Normally it will be preferred to use at least about 1.05 times such stoichiometric amount of hydrogen. In addition allowance has to be made for hydrogen dissolved in the recovered treated feedstock and lost in the purge gas.

In the process of the invention the rate of supply of make up hydrogen-containing gas typically corresponds to an $H_2$:feedstock molar feed ratio of from about 1:20 to about 20:1; preferably this ratio is selected in accordance with the anticipated chemical hydrogen consumption as well as the physical losses from the system and can vary over a wide range due to the variety of feed sources and product specifications. Where the feedstock, for example a technical grade white oil, has previously been treated with hydrogen, then very low make-up $H_2$:feedstock molar ratios are required. When the feedstock is, for example, a middle distillate fraction or a gas oil derived from a petroleum residuum coking operation, then a high specific consumption of hydrogen is required.

The process of the invention is carried out in a plant having first and second hydrotreatment zones. Each of these zones can consist of a single reactor or of a plurality of reactors connected in series.

Different hydrotreatment conditions may be used in the two zones. Thus, for example, the temperature and/or the pressure in the second hydrotreatment zone may be higher than in the first such zone. Although the reaction may be carried out under near isothermal conditions using shell-and-tube reactors, it is preferred to operate the hydrotreatment zones under adiabatic reaction conditions.

In a preferred process according to the present invention the liquid hydrocarbon feedstock to be hydrotreated in the first hydrotreatment zone is supplied thereto in the form of a liquid mixture with a compatible diluent. In this way the risk of temperature runaway and hydrocracking occurring in the first hydrotreatment zone is minimised, especially if the feedstock is highly unsaturated. Conveniently the compatible diluent comprises liquid material recycled from the exit end of the zone. It is also possible to dilute the material supplied to the second hydrotreatment zone in a similar manner with a compatible diluent, such as liquid from the exit end of the second zone. The second hydrotreatment zone can be operated advantageously with a feed with little or no added liquid diluent, such as recycled liquid product.

The removal of $H_2S$ in the stripping step (e) reduces the $H_2S$ partial pressure between the exit of the first hydrotreatment zone and the inlet to the second hydrotreatment zone, thus effectively allowing the liquid feedstock to encounter catalyst that, whilst still remaining adequately sulphided to obviate the danger of hydrocracking reactions, increases in average activity from the first hydrotreatment zone to the second hydrotreatment zone. It further ensures that the $H_2$ partial pressure is highest at the inlet to the second hydrotreatment zone so as to provide optimum conditions for hydrodesulphurising the residual less reactive organic sulphurous impurities in the second liquid hydrocarbon fraction. The advantage of using a higher hydrogen partial pressure in the second hydrotreatment zone is that the plant operator can run the second hydrotreatment zone at a higher than usual operating temperature and thereby achieve further desulphurisation and denitrogenation with no loss of useful catalyst life. Alternatively by operating at the usual operating temperature longer than usual useful catalyst life can be obtained. If desired a different catalyst can be used in the second hydrotreatment zone from that used in the first hydrotreatment zone, for example a catalyst that has special aromatic saturation propensity even in the presence of some free $H_2S$, such as a catalyst of the type disclosed in U.S. Pat. No. 5,147,526.

In passage through the first hydrotreatment zone the more readily reduced organic sulphur compounds will react preferentially to give a mixture of $H_2S$ and the corresponding hydrocarbons. However, the less reactive sulphur compounds will be more resistant to hydrogenation. Hence the intermediate product mixture from the first hydrotreatment zone contains besides unreacted hydrogen, also $H_2S$, liquid hydrocarbons and residual unreactive organic sulphurous impurities. These residual organic sulphurous impurities will typically have significantly higher boiling points than the lighter hydrocarbon components of the intermediate product mixture. Hence when this product mixture is separated in step (e) into two cuts, it is possible to obtain a "low boiling" hydrocarbon cut with a low sulphur content (i.e. the second hydrocarbon fraction of step (e)) and a "high boiling" cut which contains the major proportion of the residual organic sulphur content of the intermediate product stream (.i.e. the third liquid hydrocarbon fraction of step (e)). For a particular hydrocarbon feedstock it may be necessary to conduct a trial or a few trials to determine the temperature and pressure conditions needed to obtain such a separation into two cuts in step (e). However such trial experiments will be of a routine nature.

In step (j) unreacted gas from the first hydrotreatment zone is subjected to $H_2S$ removal prior to admixture with make-up hydrogen-containing gas to form the hydrogen-containing gas used in steps (e) and (f). Such unreacted gas contains $H_2S$ resulting from hydrodesulphurisation, as well as ammonia resulting from denitrogenation. Typical methods of $H_2S$ removal include, for example, washing with a solution of an amine such as mono-, di- or triethanolamine. Such a washing step will also remove some of the ammonia in the gas stream. Further removal of ammonia can be carried out by washing with water. The desulphurised gas can then be compressed and passed on for admixture in step (l) with the make-up hydrogen-containing gas to form the hydrogen-containing gas supplied to the second hydrotreatment zone.

A purge gas stream may be taken to control the level of inert gases in the desulphurised gas.

If significant quantities of ammonia are generated in one or other of the hydrotreatment zones it may be necessary to subject the resulting liquid hydrocarbon product stream from that zone to a water washing step to prevent deposit of solid phase ammonium sulphides, such as $(NH_4)HS$, on the cooler plant surfaces, such as heat exchanger surfaces. The water used in such a water washing step can be separated from the liquid hydrocarbon stream and subjected to appropriate purification treatment before reuse or discharge to the environment.

It is important that the catalyst be in adequately sulphided form in each of the two hydrotreatment zones in order to avoid the danger of hydrocracking reactions taking place. Thus it may be desirable to ensure that there is a little $H_2S$ in the feed streams to the hydrotreatment zones. In the process of the invention the recycle of the unscrubbed gas from step (m) to step (b) ensures that free $H_2S$ is always present at the inlet end of the first hydrotreatment zone. A sufficient inlet $H_2S$ partial pressure to the second hydrotreatment zone will normally be maintained by the presence of dissolved $H_2S$ in the third liquid hydrocarbon fraction in order to keep the catalyst in the second hydrotreatment zone in a sufficiently sulphided form to obviate the danger of hydrocracking in this zone. The catalyst activity will tend to be highest in this zone so that the conditions in this zone are favourable not only for effecting hydrodesulphurisation but also for effecting hydrogenation of aromatic compounds. Hence, under suitable operating conditions, a significant reduction of the aromatic hydrocarbon content of the feedstock can be effected, while at the same time achieving efficient removal of the less reactive sulphur-containing materials.

It is also envisaged that different catalysts can be used in different zones in the process of the invention. In this case a catalyst favouring hydrodesulphurisation, rather than hydrogenation of aromatic compounds, can be used in the first zone, for example a sulphided CoO—$MoO_3$/gamma-$Al_2O_3$ catalyst, such as Cyanamid Aero Trilobe HDS-20 which has a content of 10.8 wt % Mo and 3.9 wt % Co on a sulphide free basis. A catalyst that has greater activity for hydrogenation of aromatic compounds, for example a sulphided NiO—$WO_3$-gamma-$Al_2O_3$ catalyst, such as Katalco Sphericat NT-550 which has a content of 15.8 wt % W and 3.9 wt % Ni on a sulphide free basis, can be used in the second hydrotreatment zone.

In the process of the invention it is desirable that the sulphur contents of the gas and liquid feeds to the first hydrotreatment zone are monitored to ensure that there is sufficient $H_2S$ present to maintain the catalyst in sulphided form. More often than not the feedstock will contain sufficient active sulphur-containing material or the hydrogen-containing gas fed thereto (i.e. unscrubbed gas from step (m)) will contain sufficient $H_2S$, or both, to maintain the catalyst in sufficiently sulphided form. By the term active sulphur-containing materials there is meant materials which very rapidly form $H_2S$ under hydrotreatment conditions in the presence of a hydrotreatment catalyst. Examples of such materials include, or example, $CS_2$, COS, alkyl mercaptans, dialkyl sulphides, and dialkyl disulphides.

Normally it will suffice to provide at the inlet end to the first hydrotreatment zone a sulphur concentration, in the form of $H_2S$ or of an active sulphur material, of at least about 1 ppm, and preferably at least about 5 ppm, up to about 1000 ppm. Typically the sulphur concentration may range from about 10 ppm upwards, e.g. from about 40 ppm up to about 100 ppm.

The feedstock to be treated is typically supplied at a liquid hourly space velocity of from about 0.1 $hr^{-1}$ to about 15 $hr^{-1}$, for example about 0.2 $hr^{-1}$ to about 12 $hr^{-1}$, e.g. about 0.5 to about 8 $hr^{-1}$. By the term liquid hourly space velocity (LHSV) there is meant the volume of liquid feed passing per hour through a unit volume of the respective catalyst bed. The actual LHSV used will be strongly dependent upon the nature of the feedstock and upon the product quality which is desired.

It will be appreciated by those skilled in the art that, as FIGS. 1 to 4 are diagrammatic, further items of equipment such as heaters, heat exchangers, coolers, temperature sensors, temperature controllers, pressure sensors, pressure relief valves, control valves, level controllers, and the like, would additionally be required in a commercial plant. Additionally it will be apparent that the hydrotreatment zones can be located in separate vessels or in a single vessel provided with mechanical or hydraulic means to separate the zones one from another. The provision of such ancillary items of equipment and the arrangements for separating the hydrotreatment zones one from another form no part of the present invention and would be in accordance with conventional chemical engineering practice.

DETAILED DESCRIPTION OF THE INVENTION

Figure 1:
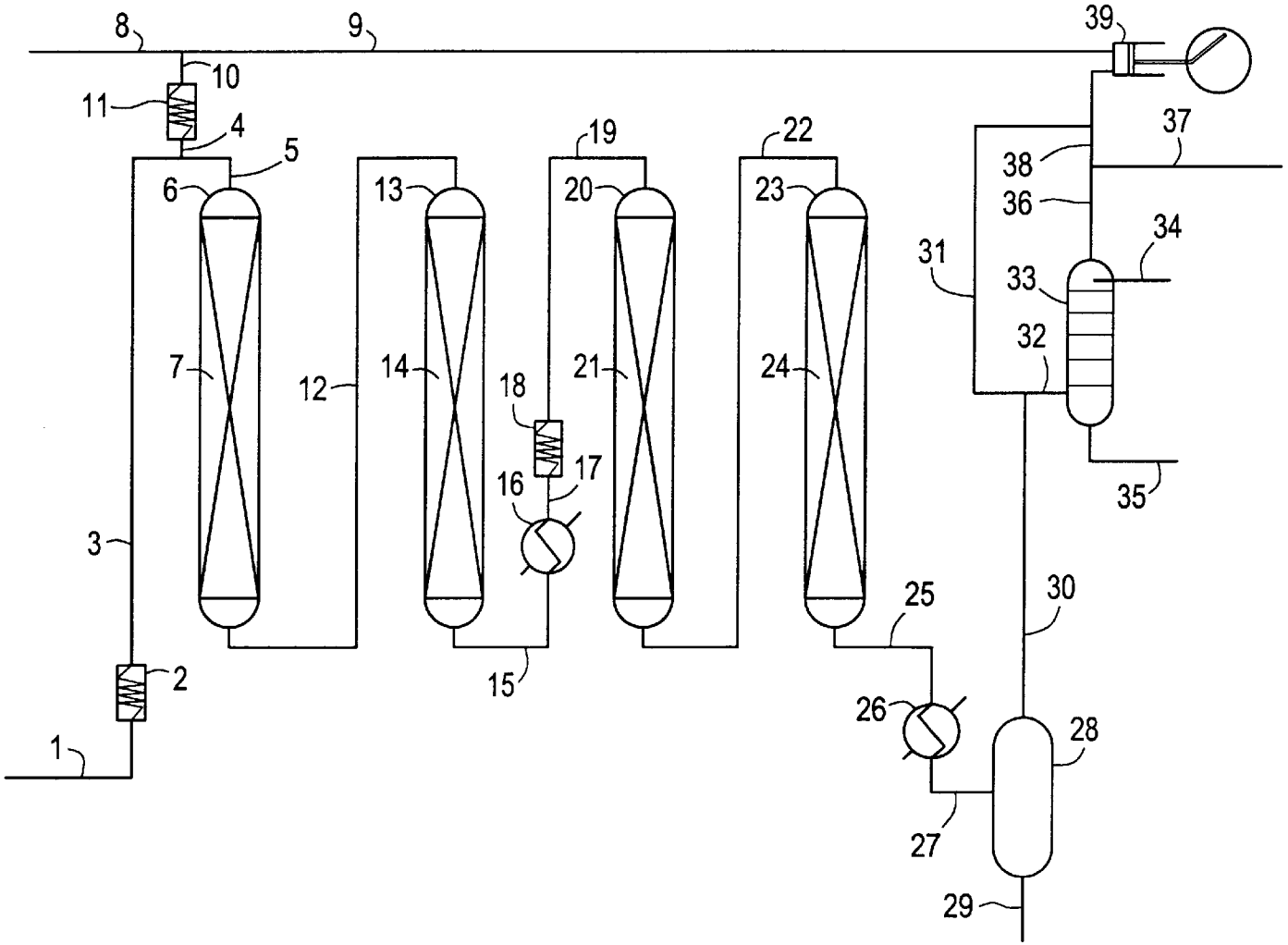
FIG. 1 is a flow diagram of a conventional hydrotreatment plant.

Referring to FIG. 1 of the drawings, the illustrated pilot plant has four reactors. Fresh liquid hydrocarbon feedstock to be hydrotreated, e.g. a diesel oil fraction, flows in line 1 through heater 2 and line 3 and is mixed with a mixture of make-up hydrogen and recycle hydrogen-containing gas from line 4. The resulting mixture passes forward in line 5 to a first hydrotreatment reactor 6 which contains a bed 7 of a hydrotreatment catalyst. The catalyst can be any one of those mentioned above, such as a sulphided nickel-molybdate catalyst ($NiMoS_x$). Make-up gas is supplied in line 8 to the plant and is mixed with recycled hydrogen-containing gas from line 9 to flow on in line 10 through heater 11 to line 4 and then on via line 5 to reactor 6. Reactor 6 can be operated isothermally or adiabatically.

The hydrogen-containing gas in line 8 typically contains, in addition to a major amount of hydrogen (i.e more than 50%, e.g. about 80% of hydrogen), a mixture of inert gases, such as nitrogen, argon, methane, ethane, propane, and the like. It may have, for example, the composition set out in Table I below.

TABLE 1

| Component | Mol % |
|---|---|
| Hydrogen | 75.00 |
| Methane | 7.60 |
| Ethane | 10.60 |
| Propane | 4.80 |
| Butane | 0.20 |
| Pentane | 0.20 |
| Hexane | 1.40 |
| Nitrogen | 0.30 |
| Total | 100.00 |
| Mol wt | 9.56 |

As indicated in FIG. 1 reactor 1 comprises an elongated cylinder having a length of 3 m. It is wrapped around with an inner insulation layer (not shown). Around the inner insulation layer are positioned nine separate outer sheet metal cylinders which are spaced one from another axially of the reactor 6. Each outer sheet metal cylinder is wound with an electrical heating element and is wrapped about with an outer layer of insulation. A set of thermocouples (not shown) is provided corresponding to each outer sheet metal cylinder. Each set comprises a thermocouple positioned adjacent the axial midpoint of the respective outer sheet metal cylinder, one positioned at the corresponding axial position on the reactor wall and a third one at a corresponding axial position in the middle of the catalyst bed 7.

In the adiabatic mode of operation the temperature as measured by a thermocouple in the catalyst bed is maintained on the adjacent outer metal cylinder by automatically adjusting the power input to the associated electrical heating element for that outer sheet metal cylinder. Any change in the temperature of the catalyst bed is matched by a corresponding change in the temperature of the outer sheet metal cylinder so that there is no net heat flow into or out of the reactor 6 and that section of the reactor 6 operates adiabatically.

In the isothermal mode of operation the desired temperature of the catalyst bed 7 within each section, as defined by a respective outer sheet metal cylinder, is set by automatic instrumentation and the temperature of the corresponding outer sheet metal cylinder is adjusted so as to maintain that desired temperature within that section of the catalyst bed 7. If necessary, a flow of air under automatic control can be supplied to the outer sheet metal cylinders to control those sections of reactor 6 wherein natural heat leakage is not sufficient to maintain the desired temperature because of a strongly exothermic hydrogenation reaction.

Figure 2:
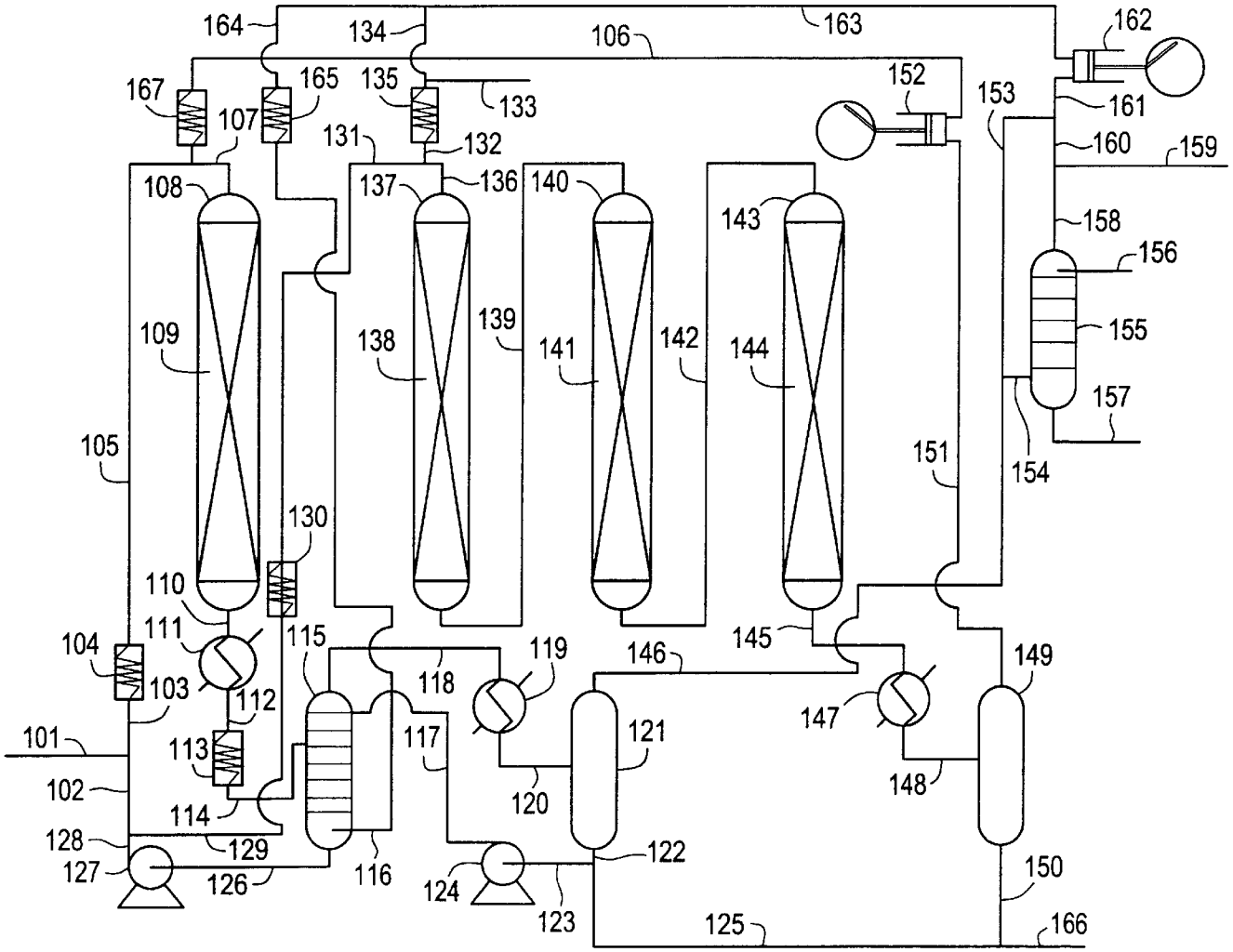
FIGS. 2 to 4 are corresponding flow diagrams of hydrotreatment plants designed to operate using the process of the present invention.
Figure 3:
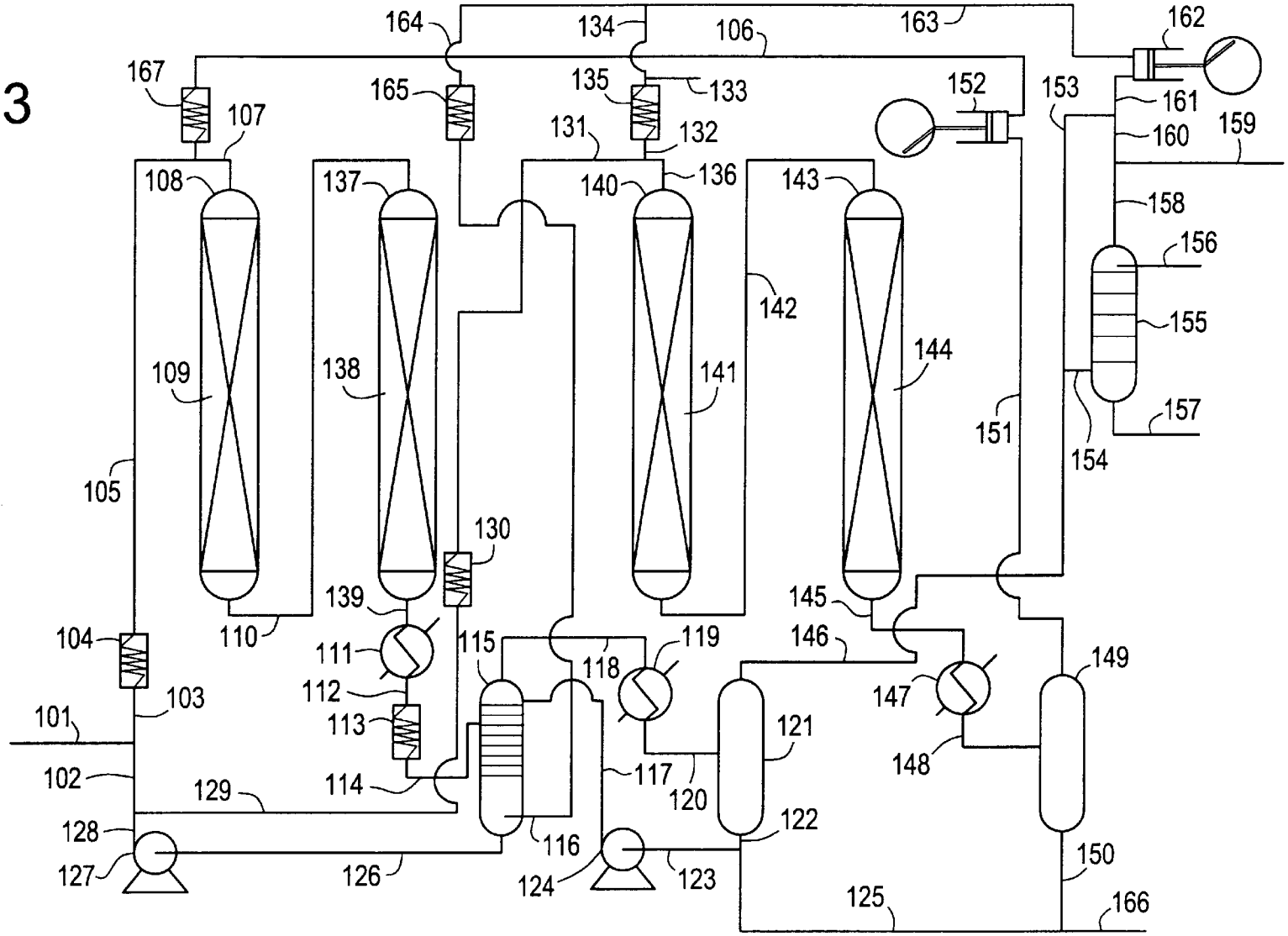
Figure 4:
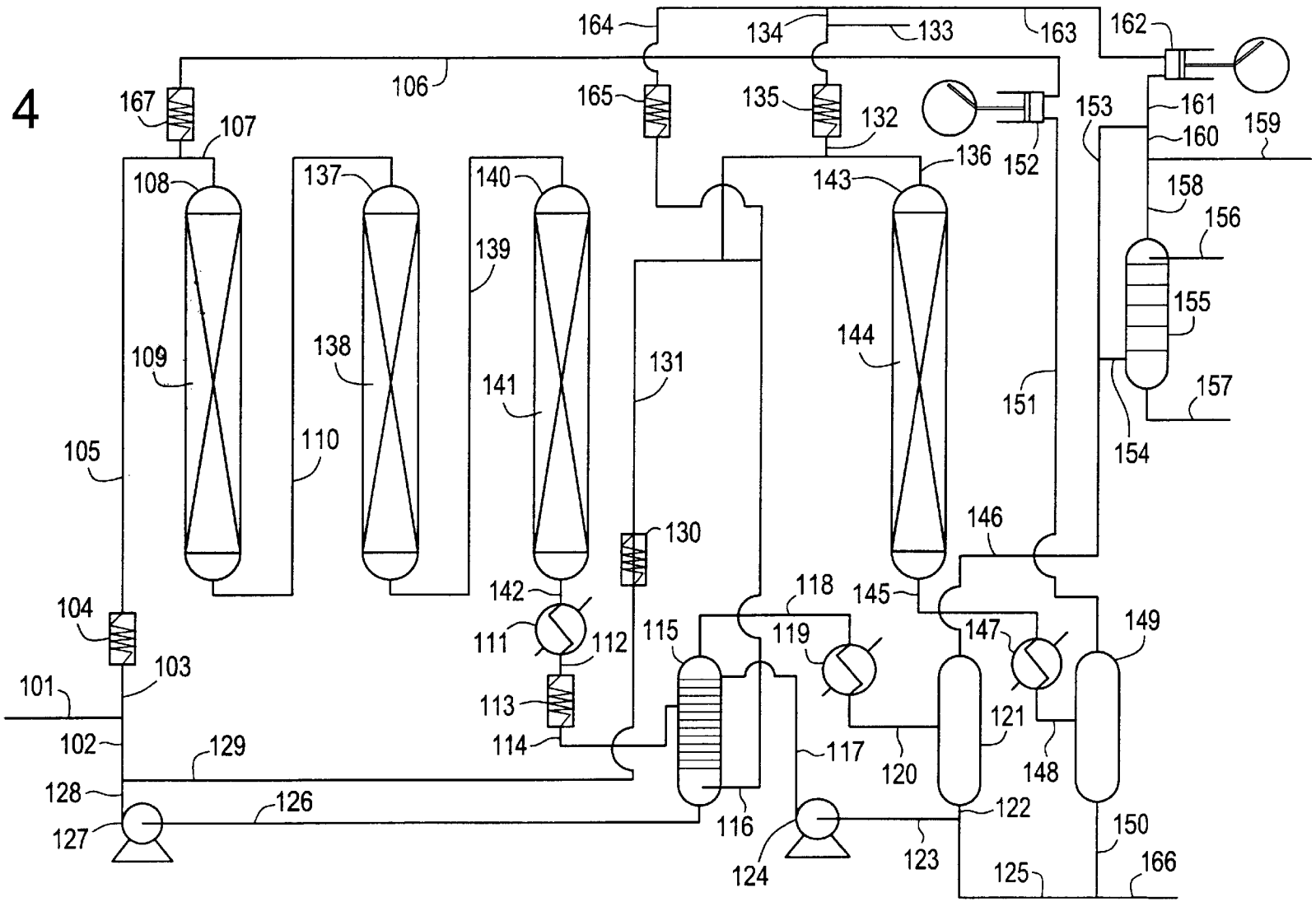

Similar methods of temperature control can be used to maintain a desired temperature in each of the other reactors of the plant of FIG. 1 to be described hereafter, as well as in the reactors of FIG. 2, FIG. 3, or FIG. 4, or in any of the lines mentioned.

The product mixture from reactor 6, which is a mixture of unreacted hydrogen, inert gases, vaporous hydrocarbons and liquid hydrocarbons, flows on in line 12 to a second reactor 13 which contains a bed 14 of the same hydrotreatment catalyst from which the resulting intermediate product mixture exits in line 15. Cooler 16 permits the temperature of the material in line 15 to be reduced. The optionally cooled mixture flows on in line 17. Heater 18, on the other hand, allows further heating of the intermediate product mixture to be effected. The provision of cooler 16 and heater 18 allows the temperature of the material entering reactor 20 to be selected to be higher than, lower than, or the same as, the temperature of the material leaving reactor 13. The optionally heated or cooled intermediate product mixture flows on in line 19 to third reactor 20, which contains a bed 21 of sulphided hydrotreatment catalyst. The catalyst of bed 21 may be the same catalyst as that of bed 7 or bed 14 or may be a different catalyst therefrom.

The material emerging from reactor 20 in line 22 flows through a fourth reactor 23 containing a corresponding bed 24 of sulphided hydrotreatment catalyst. Again the catalyst of bed 24 may be the same as that of beds 7, 14 or 21 or may be a different catalyst therefrom. The final product stream exiting the final reactor 23 is passed through cooler condenser 26 and flows on in line 27 to a cold separator 28 in which the liquid and gas phases are separated into a hydrodesulphurised oil product in line 29 and a recycle gas stream in line 30. This recycle gas stream can be divided into a bypass stream in line 31 and a main stream in line 32. Normally a majority or all of the gas stream in line 30 passes to line 32. The gas in line 32 is treated for $H_2S$ removal in amine scrubber stage 33 which is supplied with a solution of an amine, such as monoethanolamine, diethanolamine,, or triethanolamine, in line 34, the $H_2S$-loaded amine liquor being removed in line 35. Part of the hydrogen sulphide free gas in line 36 can be purged in line 37 in order to control the amount of inert gases in the circulating gas, while the remainder goes forward in line 38 to recycle compressor 39 and thence the recycle stream in line 9. The proportion of inert gases in the recycle gas stream may be as high as 25% or more, for example, up to about 50%.

The stream of spent amine wash liquor in line 35 is passed to an $H_2S$ regeneration column (not shown) to regenerate the amine wash liquor and release $H_2S$.

The pilot plant of FIG. 2 is a two stage hydrotreatment plant. Fresh preheated liquid hydrocarbon feedstock to be treated, e.g. a diesel oil fraction, is supplied in line 101. It can be mixed, if desired, with recycled liquid from line 102 before passing on in line 103 through heater 104 to line 105. The hot liquid mixture is then admixed with recycle gas from line 106 to form the inlet stream in line 107 to a first hydrotreatment reactor 108 which contains a charge 109 of a conventional granular hydrotreatment catalyst, such as a sulphided nickel molybdate catalyst ($NiMoS_x$) catalyst. Desirably the liquid is fed at a rate sufficient to maintain a superficial liquid velocity down the bed of catalyst in reactor 108 of from about 1.5 cm/sec to about 5 cm/sec, according to the teachings of WO-A-B89/05286. High catalyst geometrical surface area per unit volume of catalyst bed is particularly desirable; cylindrical extrudates, trilobe and quadrilobe extrudates, as well other extrudates with even higher surface area can be used. Such extrudates are available with diameters from about 1 mm to 3 mm or more.

The first intermediate product stream from reactor 108 flows through line 110 to an air cooler 111, in which its temperature can optionally be somewhat reduced, and flows on in line 112 to a heater 113, in which its temperature can alternatively optionally be raised, and then via line 114 to a stripping column 115 to the bottom of which is supplied a stream of desulphurised gas in line 116. Recycled liquid hydrocarbon material can be fed to the top of stripping column 115 in line 117. The upflowing gas from line 116 strips $H_2S$ from the downflowing liquid from line 117 and the liquid from line 114; the resulting $H_2S$-laden vapour stream passes on in line 118 via condenser 119 and line 120 to a separator 121. A liquid phase leaves separator 121 in line 122. Part can be passed in line 123 to pump 124 and then to line 117. The remainder is recovered in line 125. It is substantially sulphur-free and comprises the more volatile hydrocarbons present in the feedstock in line 101. (If there is no flow in line 123, then all of the liquid phase from separator 121 is recovered in line 125).

From the bottom of stripping column 115 there is recovered in line 126 a liquid hydrocarbon fraction which is pumped by pump 127 into line 128. Pump 127 can be omitted under certain circumstances which will be further explained below.

In passage through reactor 108 a proportion of the organic sulphur content of the liquid phase is converted to hydrogen sulphide. In particular the more readily hydrogenated sulphur-containing organic compounds are converted to $H_2S$ and hydrocarbons. In addition some hydrodenitrogenation may occur. Moreover substantial hydrogenation of olefins and some hydrogenation of aromatic compounds present may occur. However, sulphur present in a less readily reducible form may survive in substantially unreacted form.

Because of the difference in ease of hydrodesulphurisation of various types of sulphurous impurities which may be present in the feedstock in line 101, the lower boiling sulphurous impurities will tend to react preferentially in passage through the catalyst bed of reactor 108 whilst the higher boiling cyclic and polycyclic organic sulphurous impurities, which are more resistant to hydrodesulphurisation, remain unreacted. Hence the liquid phase intermediate product emerging from the bottom of reactor 108 in line 110 and passing to line 118 contains a reduced organic sulphur content compared with the feedstock in line 101 but that organic sulphur content is relatively resistant to hydrodesulphurisation.

Part of the liquid in line 128 can be recycled in line 102, while the remainder passes on in line 129 to heater 130, by means of which its temperature may optionally be raised, and then to line 131 to be mixed with a stream of hot hydrogen-containing gas from line 132. This consists of a mixture of make-up gas from line 133 and of recycled gas desulphurised from line 134. The resulting mixed gas stream is heated in heater 135.

The composition of the make-up gas may be as set out in Table I above.

The hydrogen-containing gas in line 133 preferably contains a major amount of hydrogen and at most a minor amount of one or more inert gases. Preferred hydrogen-containing gases are accordingly gases containing at least about 50 mole % up to about 95 mole % or more (e.g. about 99 mole %) of $H_2$ with the balance comprising one or more of $N_2$, CO, $CO_2$, Ar, He, $CH_4$ and other low molecular weight saturated hydrocarbons.

The mixture of gas and liquid proceeds via line 136 to second hydrotreatment reactor 137 which contains a charge 138 of a similar conventional sulphided hydrotreatment catalyst to that used in reactor 108. The product stream exiting reactor 137 is fed in line 139 to a third reactor 140 which contains a bed 141 of a similar hydrotreatment catalyst to that of reactors 108 and 137. Its product stream is recovered in line 142 to form a feed stream for a fourth reactor 143 also containing a bed of hydrotreatment catalyst, designated 144 in FIG. 2. Reactors 137, 140 and 143 together constitute the second hydrotreatment zone. The final product stream from the second hydrotreatment zone is recovered in line 145.

The gaseous phase from separator 121, which comprises unreacted hydrogen, inert gases, $H_2S$, and $NH_3$, is recovered in line 146.

The final product stream in line 145 goes forward to a cooler 147 and thence via line 148 to a vapour-liquid separator 149. The liquid final product is recovered in line 150 while the gas phase is recovered in line 151 and can be re-compressed by means of recycle compressor 152. Alternatively compressor 152 can be omitted if pump 127 is used to feed the liquid phase in line 126 forward through line 129.

The gas stream in line 146 and can be divided into a bypass stream in line 153 and a main stream in line 154. Normally all of the gas stream in line 146 passes to line 154. The gas in line 154 is treated for $H_2S$ removal in amine scrubber stage 155 which is supplied with an aqueous amine solution in line 156, the $H_2S$-loaded amine liquor being removed in line 157. Part of the hydrogen sulphide free gas in line 158 can be purged in line 159, while the remainder goes forward in line 160 to be recombined with any gas from line 153. It then flows on in line 161 to recycle compressor 162 and thence to line 163.

The gas in line 163 is divided; part forms the gas stream in line 134, while the remainder passes on via line 164 and heater 165 to form the stream in line 116.

In passage through reactors, 137, 140 and 143 the product from reactor 108 undergoes further hydrodesulphurisation and hydrogenation of aromatic compounds. Since the inlet gas to the second reactor 137 is a mixture of fresh hydrogen-containing feed gas and recycled desulphurised gas the hydrogen partial pressure is higher at the inlet to reactor 137 than at the inlet to reactor 108. Hence the conditions are more favourable in reactor 137 than those in reactor 108 for effecting hydrotreatment of the sulphur-containing compounds that are relatively more resistant to hydrodesulphurisation.

A monitor (not shown) is installed in line 163 to detect the concentration of $H_2S$ in the recycle gas in line 163; this monitor controls a valve (not shown) in line 153 which determines the flow rate of bypass gas in line 153. This bypass gas contains $H_2S$ since it has not passed through amine scrubber stage 155. By this means it can be ensured that the recycle gas contains sufficient $H_2S$ to keep the catalyst bed 138 adequately sulphided.

Reference numeral 166 indicates a line by means of which the streams in lines 125 and 150 can be combined to form a common final desulphurisation product. Reference numeral 167 indicates a heater in line 106.

The plant of FIG. 3 is generally similar to that of FIG. 2 and the same reference numerals have been used in the two Figures to indicate like parts. The plant of FIG. 3 differs from that of FIG. 2 in that, whereas in the plant of FIG. 2 the total catalyst charge is split between the first and second hydrotreatment zones in the volume ratio 25:75, in the plant of FIG. 3 the ratio is 50:50. Thus line 110 is connected directly to reactor 137 and line 139 leads to cooler 111. Also line 136 is connected to reactor 140.

The plant of FIG. 4 is also similar to that of FIG. 2 except that the total catalyst charge is split between the first and second hydrotreatment zones in the volume ratio 75:25. Thus the same reference numerals are used in FIG. 4 as in FIG. 2. It will be noted that, in the plant of FIG. 4, line 110 is connected to reactor 137, line 142 is connected to cooler 111 and line 136 to reactor 143.

The invention is further illustrated with reference to the following Examples in which all percentages are by weight, except where otherwise specified.

The compositions of the diesel and gas oil feedstocks used in the Examples are as set out in Table II below.

TABLE II

| | Diesel oil feed | Gas oil feed |
|---|---|---|
| Molecular weight | 196.26 | 383.49 |
| Density (API) | 32.00 | 18.80 |
| Density (kg/m$^3$) | 865.44 | 941.45 |
| Sulphur (wt ppm) | 8937 | 21736 |
| Nitrogen (wt ppm) | 796.00 | 1182 |
| Mol % S species | 5.46 | 25.96 |
| Mol % aromatics | 33.78 | 39.15 |
| Mol % N species | 0.56 | 3.24 |
| Mol % olefins | 5.10 | 0.00 |
| % C in aromatic rings | 35.20 | 38.20 |
| Boiling range (° C.): | | |
| Initial boiling point | 202.4 | 379.8 |
| 20% | 227.2 | 388.2 |
| 50% | 266.1 | 435.7 |
| 80% | 288.3 | 467.7 |
| Final boiling point | 362.6 | 523.7 |

In the Tables "ppm" indicates parts per million by weight.

EXAMPLE 1 (COMPARATIVE EXAMPLE)

The diesel feedstock of Table II is supplied to a plant of the type illustrated in FIG. 1. The plant is operated isothermally, the catalyst beds being maintained at 315.6° C. The operating conditions and molar compositions of the more important streams are set out in Table III below. In this and all succeeding Examples a feedstock flow rate equivalent to 1 kg feedstock per liter of catalyst per hour is used.

TABLE III

| Line No. | 8 | 1 | 9 | 17 | 30 | 29 | 37 | 34 |
|---|---|---|---|---|---|---|---|---|
| $H_2$ | 69.20 | — | 84.94 | 111.52 | 100.16 | 1.55 | 15.21 | — |
| $H_2S$ | 0.00 | — | trace | 4.98 | 2.67 | 2.47 | — | 2.67 |
| $NH_3$ | 0.00 | — | trace | 0.06 | 0.04 | 0.07 | — | 0.04 |
| $CH_4$ | 7.01 | — | 21.23 | 28.24 | 25.04 | 3.21 | 3.80 | — |
| $C_2H_6$ | 9.69 | — | 10.35 | 20.04 | 12.21 | 7.84 | 1.85 | — |
| $C_3H_8$ | 4.43 | — | 1.73 | 6.16 | 2.04 | 4.12 | 0.31 | — |
| $C_4H_{10}$ | 0.19 | — | 0.02 | 0.21 | 0.03 | 0.18 | — | — |
| $C_5H_{12}$ | 0.19 | — | 0.01 | 0.19 | 0.01 | 0.18 | — | — |
| $C_6H_{14}$ | 1.29 | — | 0.02 | 1.32 | 0.02 | 1.29 | — | — |
| $N_2$ | 0.28 | — | 1.28 | 1.56 | 1.51 | 0.05 | 0.23 | — |
| Oil | 0.00 | 100.00 | 0.01 | 100.02 | 0.01 | 100.00 | — | — |
| Total | 92.28 | 100.00 | 119.59 | 274.30 | 143.74 | 120.96 | 21.40 | 2.71 |
| ppm S in oil | — | 8937 | — | 866 | — | 524 | — | — |
| ppm N in oil | — | 796 | — | 718 | — | 645 | — | — |
| % aromatic C | — | 35.2 | — | 15.4 | — | 7.2 | — | — |
| Temperature °C. | 40.3 | 84.1 | 40.0 | 315.6 | 40.5 | 40.5 | 40.5 | 40.5 |
| Pressure bar | 49.3 | 49.3 | 49.3 | 49.2 | 49.1 | 49.1 | 3.9 | 49.0 |

EXAMPLE 2 (COMPARATIVE EXAMPLE)

The procedure of Example 1 is repeated except that the plant of FIG. 1 is operated adiabatically. The same diesel feed is used. The conditions and molar compositions of the most important streams in the plant are set out in Table IV below. The inlet temperature in line 5 is 283.9° C., the temperature in lines 15 and 19 is 325.7° C. and that in line 25 is 336.9° C.

TABLE IV

| Line No. | 8 | 1 | 9 | 17 | 30 | 29 | 37 | 34 |
|---|---|---|---|---|---|---|---|---|
| $H_2$ | 69.20 | — | 83.41 | 110.61 | 96.83 | 1.53 | 13.43 | — |
| $H_2S$ | 0.00 | — | trace | 4.98 | 2.71 | 2.54 | — | 2.71 |
| $NH_3$ | 0.00 | — | trace | 0.06 | 0.05 | 0.09 | — | 0.05 |
| $CH_4$ | 7.01 | — | 22.44 | 29.46 | 26.06 | 3.40 | 3.61 | — |
| $C_2H_6$ | 9.69 | — | 10.55 | 20.24 | 12.25 | 7.99 | 1.70 | — |
| $C_3H_8$ | 4.43 | — | 1.74 | 6.17 | 2.02 | 4.15 | 0.28 | — |
| $C_4H_{10}$ | 0.19 | — | 0.02 | 0.21 | 0.03 | 0.18 | — | — |
| $C_5H_{12}$ | 0.19 | — | 0.01 | 0.20 | 0.01 | 0.18 | — | — |
| $C_6H_{14}$ | 1.29 | — | 0.02 | 1.31 | 0.02 | 1.29 | — | — |
| $N_2$ | 0.28 | — | 1.40 | 1.68 | 1.63 | 0.05 | 0.23 | — |
| Oil | 0.00 | 100.00 | 0.01 | 100.02 | 0.01 | 100.01 | — | — |
| Total | 92.28 | 100.00 | 119.60 | 274.94 | 141.62 | 121.41 | 19.25 | 2.76 |
| ppm S in oil | — | 8937 | — | 800 | — | 375 | — | — |
| ppm N in oil | — | 796 | — | 719 | — | 600 | — | — |
| % aromatic C | — | 35.2 | — | 15.9 | — | 6.0 | — | — |
| Temperature °C. | 40.3 | 84.1 | 40.0 | 325.7 | 40.5 | 40.5 | 40.5 | 40.5 |
| Pressure bar | 49.3 | 49.3 | 49.3 | 49.2 | 49.1 | 49.1 | 3.9 | 49.0 |

EXAMPLE 3

The same diesel oil feed is hydrotreated in a plant of the type illustrated in FIG. 2 in which 25% of the catalyst is placed in the first of the hydrotreatment zones and 75% thereof in the second hydrotreatment zone. Operation is effected under isothermal conditions with all the catalyst being at 315.6° C. The process conditions and compositions of some of the streams are set out in Table V below. There is no flow in line 102 or in line 123. 92.77% of the $H_2S$ present in line 110 appears in line 118 while only 7.23% thereof passes to line 131.

TABLE V

| Line No. | 133 | 101 | 163 | 118 | 131 | 146 | 166 | 159 | 157 | 125 | 106 |
|---|---|---|---|---|---|---|---|---|---|---|---|
| $H_2$ | 69.20 | — | 75.65 | 98.21 | 5.22 | 97.86 | 1.81 | 13.81 | — | 0.36 | 128.42 |
| $H_2S$ | 0.00 | — | trace | 5.39 | 0.42 | 4.44 | 0.91 | — | 4.44 | 0.95 | 1.09 |
| $NH_3$ | 0.00 | — | trace | 0.07 | 0.01 | 0.05 | 0.07 | — | 0.05 | 0.02 | 0.05 |

TABLE V-continued

| Line No. | 133 | 101 | 163 | 118 | 131 | 146 | 166 | 159 | 157 | 125 | 106 |
|---|---|---|---|---|---|---|---|---|---|---|---|
| $CH_4$ | 7.01 | — | 20.73 | 27.61 | 2.39 | 26.82 | 3.23 | 3.78 | — | 0.79 | 27.70 |
| $C_2H_6$ | 9.69 | — | 8.88 | 13.16 | 1.71 | 11.48 | 8.07 | 1.62 | — | 1.68 | 13.88 |
| $C_3H_8$ | 4.43 | — | 1.11 | 2.08 | 0.35 | 1.43 | 4.23 | 0.20 | — | 0.65 | 2.31 |
| $C_4H_{10}$ | 0.19 | — | 0.01 | 0.03 | 0.01 | 0.01 | 0.18 | — | — | 0.02 | 0.03 |
| $C_5H_{12}$ | 0.19 | — | trace | 0.01 | trace | trace | 0.18 | — | — | 0.01 | 0.01 |
| $C_6H_{14}$ | 1.29 | — | trace | 0.02 | 0.01 | trace | 1.29 | — | — | 0.02 | 0.03 |
| $N_2$ | 0.28 | — | 1.27 | 1.65 | 0.09 | 1.64 | 0.05 | 0.23 | — | 0.03 | 1.61 |
| Oil | 0.00 | 100.00 | 0.01 | 19.44 | 80.58 | 0.01 | 100.00 | — | — | 19.42 | 0.01 |
| Total | 92.28 | 100.00 | 107.64 | 166.66 | 90.79 | 143.74 | 120.02 | 19.64 | 4.49 | 23.92 | 175.13 |
| ppm S in oil | — | 8937 | — | 292 | 1422 | — | 191 | — | — | 292 | — |
| ppm N in oil | — | 796 | — | 604 | 788 | — | 630 | — | — | 604 | — |
| % aromatic C | — | 35.2 | — | 18.3 | 23.9 | — | 6.8 | — | — | 18.3 | — |
| Temperature °C. | 40.3 | 84.1 | 40.0 | 315.6 | 315.6 | 40.5 | 40.5 | 40.5 | 40.5 | 40.4 | 40.0 |
| Pressure bar | 49.3 | 49.3 | 49.3 | 49.2 | 49.2 | 49.1 | 49.1 | 3.9 | 49.0 | 49.2 | 49.5 |

EXAMPLE 4

The procedure of Example 3 is repeated except that the plant of FIG. 3 is used. Isothermal conditions are used with all the catalyst at 315.6° C. Again there is no flow in line 102 or in line 123. The corresponding results are given in Table VI. 92.75% of the $H_2S$ present in line 139 appears in line 118 while only 7.25% thereof passes into line 131.

EXAMPLE 5

The procedure of Example 3 is repeated except that the plant of FIG. 4 is used. Isothermal conditions are used. Again there is no flow in line 102 or in line 123. The corresponding results are given in Table VII. 92.77% of the $H_2S$ in line 142 appears in line 118 while only 7.23% thereof appears in line 131.

TABLE VI

| Line No. | 133 | 101 | 163 | 118 | 131 | 146 | 166 | 159 | 157 | 125 | 106 |
|---|---|---|---|---|---|---|---|---|---|---|---|
| $H_2$ | 69.20 | — | 74.39 | 96.35 | 5.14 | 96.00 | 1.82 | 13.34 | — | 0.35 | 136.00 |
| $H_2S$ | 0.00 | — | trace | 5.50 | 0.43 | 4.52 | 0.79 | — | 4.52 | 0.98 | 1.00 |
| $NH_3$ | 0.00 | — | trace | 0.09 | 0.01 | 0.06 | 0.05 | — | 0.06 | 0.02 | 0.04 |
| $CH_4$ | 7.01 | — | 21.47 | 28.53 | 2.48 | 27.70 | 3.16 | 3.85 | — | 0.83 | 28.62 |
| $C_2H_6$ | 9.69 | — | 9.31 | 13.78 | 1.80 | 12.01 | 8.02 | 1.67 | — | 1.77 | 14.54 |
| $C_3H_8$ | 4.43 | — | 1.16 | 2.19 | 0.37 | 1.50 | 4.22 | 0.21 | — | 0.69 | 2.43 |
| $C_4H_{10}$ | 0.19 | — | 0.01 | 0.03 | 0.01 | 0.01 | 0.18 | — | — | 0.02 | 0.03 |
| $C_5H_{12}$ | 0.19 | — | trace | 0.01 | trace | trace | 0.18 | — | — | 0.01 | 0.01 |
| $C_6H_{14}$ | 1.29 | — | trace | 0.02 | 0.01 | trace | 1.29 | — | — | 0.02 | 0.03 |
| $N_2$ | 0.28 | — | 1.30 | 1.69 | 0.10 | 1.67 | 0.04 | 0.23 | — | 0.03 | 1.64 |
| Oil | 0.00 | 100.00 | 0.01 | 19.50 | 80.51 | 0.01 | 100.00 | — | — | 19.49 | 0.01 |
| Total | 92.28 | 100.00 | 107.64 | 167.68 | 90.85 | 143.50 | 119.76 | 19.30 | 4.58 | 146.59 | 184.35 |
| ppm S in oil | — | 8937 | — | 178 | 1026 | — | 251 | — | — | 178 | — |
| ppm N in oil | — | 796 | — | 572 | 746 | — | 633 | — | — | 572 | — |
| % aromatic C | — | 35.2 | — | 12.1 | 15.8 | — | 6.3 | — | — | 12.1 | — |
| Temperature °C. | 40.3 | 84.1 | 40.0 | 315.6 | 315.6 | 40.5 | 40.5 | 40.5 | 40.5 | 40.1 | 40.0 |
| Pressure bar | 49.3 | 49.3 | 49.3 | 49.2 | 49.2 | 49.1 | 49.1 | 3.9 | 49.0 | 49.2 | 49.5 |

TABLE VII

| Line No. | 133 | 101 | 163 | 118 | 131 | 146 | 166 | 159 | 157 | 125 | 106 |
|---|---|---|---|---|---|---|---|---|---|---|---|
| $H_2$ | 69.20 | — | 73.94 | 95.94 | 5.11 | 95.58 | 1.92 | 13.43 | — | 0.36 | 141.85 |
| $H_2S$ | 0.00 | — | trace | 5.52 | 0.43 | 4.55 | 0.70 | — | 4.55 | 0.98 | 0.93 |
| $NH_3$ | 0.00 | — | trace | 0.01 | 0.01 | 0.07 | 0.03 | — | 0.07 | 0.03 | 0.03 |
| $CH_4$ | 7.01 | — | 21.67 | 28.84 | 2.50 | 28.00 | 3.09 | 3.93 | — | 0.84 | 28.94 |
| $C_2H_6$ | 9.69 | — | 9.55 | 14.19 | 1.84 | 12.35 | 7.96 | 1.73 | — | 1.84 | 14.96 |
| $C_3H_8$ | 4.43 | — | 1.20 | 2.26 | 0.38 | 1.56 | 4.20 | 0.22 | — | 0.70 | 2.50 |
| $C_4H_{10}$ | 0.19 | — | 0.01 | 0.03 | 0.01 | 0.02 | 0.19 | — | — | 0.02 | 0.03 |
| $C_5H_{12}$ | 0.19 | — | trace | 0.01 | trace | trace | 0.19 | — | — | 0.01 | 0.02 |
| $C_6H_{14}$ | 1.29 | — | trace | 0.02 | 0.01 | trace | 1.29 | — | — | 0.02 | 0.03 |
| $N_2$ | 0.28 | — | 1.27 | 1.65 | 0.09 | 1.63 | 0.03 | 0.22 | — | 0.01 | 1.60 |

TABLE VII-continued

| Line No. | 133 | 101 | 163 | 118 | 131 | 146 | 166 | 159 | 157 | 125 | 106 |
|---|---|---|---|---|---|---|---|---|---|---|---|
| Oil | 0.00 | 100.00 | 0.01 | 19.57 | 80.44 | 0.00 | 100.01 | — | — | 19.57 | 0.01 |
| Total | 92.28 | 100.00 | 107.64 | 168.14 | 90.81 | 143.76 | 119.51 | 19.53 | 4.61 | 24.38 | 190.90 |
| ppm S in oil | — | 8937 | — | 161 | 820 | — | 360 | — | — | 161 | — |
| ppm N in oil | — | 796 | — | 561 | 715 | — | 639 | — | — | 561 | — |
| % aromatic C | — | 35.2 | — | 8.0 | 10.4 | — | 6.2 | — | — | 8.0 | — |
| Temperature °C. | 40.3 | 84.1 | 40.0 | 315.6 | 315.6 | 40.5 | 40.5 | 40.5 | 40.5 | 40.4 | 40.0 |
| Pressure bar | 49.3 | 49.3 | 49.3 | 49.2 | 49.2 | 49.1 | 49.1 | 3.9 | 49.0 | 49.2 | 49.5 |

EXAMPLE 6

The diesel feedstock of Table II is supplied to the plant of FIG. 2, which is used under adiabatic conditions. The inlet temperature to reactor 108 is 283.9° C., the exit temperature in line 110 being 317.2° C. The inlet temperature to reactor 137 is 317.2° C., while the exit temperature in line 145 is 342.4° C. Again there is no flow in line 102 or in line 123. 92.71% of the $H_2S$ in line 110 appears in the vapour in line 118, while only 7.29% thereof appears in line 131. The results are set out in Table VIII.

EXAMPLE 7

In this Example the plant of FIG. 3 is operated with the diesel feedstock of Table II under adiabatic conditions. There is no flow in line 102 or in line 123. An inlet temperature of 283.9° C. is used to reactor 108, the exit temperature from reactor 137 being 327.7° C. The inlet temperature to reactor 140 is 327.7° C. and the exit temperature from reactor 143 is 342.0° C. The $H_2S$ in line 139 is split 93.60% to the vapour in line 118 and 6.40% in line 131. The results are set out in Table IX.

TABLE VIII

| Line No. | 133 | 101 | 163 | 118 | 131 | 146 | 166 | 159 | 157 | 125 | 106 | 116 |
|---|---|---|---|---|---|---|---|---|---|---|---|---|
| $H_2$ | 69.20 | — | 74.47 | 95.32 | 5.16 | 94.96 | 1.79 | 12.21 | — | 0.36 | 122.92 | 8.27 |
| $H_2S$ | 0.00 | — | trace | 5.34 | 0.42 | 4.37 | 1.03 | — | 4.37 | 0.97 | 1.20 | — |
| $NH_3$ | 0.00 | — | trace | 0.09 | 0.01 | 0.06 | 0.11 | — | 0.06 | 0.02 | 0.07 | — |
| $CH_4$ | 7.01 | — | 21.78 | 28.62 | 2.51 | 27.77 | 3.44 | 3.57 | — | 0.85 | 28.70 | 2.42 |
| $C_2H_6$ | 9.69 | — | 8.90 | 13.06 | 1.71 | 11.35 | 8.23 | 1.46 | — | 1.71 | 13.78 | 0.99 |
| $C_3H_8$ | 4.43 | — | 1.09 | 2.04 | 0.35 | 1.39 | 4.25 | 0.18 | — | 0.65 | 2.27 | 0.12 |
| $C_4H_{10}$ | 0.19 | — | 0.01 | 0.03 | 0.01 | 0.01 | 0.18 | — | — | 0.02 | 0.03 | — |
| $C_5H_{12}$ | 0.19 | — | 0.01 | 0.01 | 0.01 | 0.01 | 0.18 | — | — | 0.02 | 0.01 | — |
| $C_6H_{14}$ | 1.29 | — | trace | 0.02 | 0.01 | 0.01 | 1.29 | — | — | 0.01 | 0.03 | — |
| $N_2$ | 0.28 | — | 1.18 | 1.77 | 0.10 | 1.76 | 0.05 | 0.23 | — | 0.04 | 1.72 | 0.15 |
| Oil | 0.00 | 100.00 | 0.01 | 19.80 | 80.22 | 0.01 | 100.01 | — | — | 19.79 | 0.01 | 0.00 |
| Total | 92.28 | 100.00 | 107.65 | 166.10 | 90.51 | 141.70 | 120.56 | 17.65 | 4.43 | 24.44 | 170.74 | 11.95 |
| ppm S in oil | — | 8937 | — | 403 | 1733 | — | 99 | — | — | 403 | — | — |
| ppm N in oil | — | 796 | — | 617 | 804 | — | 553 | — | — | 617 | — | — |
| % aromatic C | — | 35.2 | — | 20.0 | 25.9 | — | 5.6 | — | — | 20.0 | — | — |
| Temperature °C. | 40.3 | 84.1 | 40.0 | 317.2 | 316.0 | 40.5 | 40.5 | 40.5 | 40.5 | 40.4 | 40.0 | 317.3 |
| Pressure bar | 49.3 | 49.3 | 49.3 | 49.2 | 49.2 | 49.1 | 49.1 | 3.9 | 49.0 | 49.2 | 49.5 | 49.2 |

TABLE IX

| Line No. | 133 | 101 | 163 | 118 | 131 | 146 | 166 | 159 | 157 | 125 | 106 | 116 |
|---|---|---|---|---|---|---|---|---|---|---|---|---|
| $H_2$ | 69.20 | — | 72.89 | 93.01 | 5.03 | 92.58 | 1.80 | 11.60 | — | 0.43 | 132.09 | 8.10 |
| $H_2S$ | 0.00 | — | trace | 5.70 | 0.39 | 4.49 | 0.93 | — | 4.49 | 1.20 | 1.15 | — |
| $NH_3$ | 0.00 | — | trace | 0.12 | 0.01 | 0.09 | 0.09 | — | 0.09 | 0.03 | 0.07 | — |
| $CH_4$ | 7.01 | — | 22.85 | 30.11 | 2.54 | 29.03 | 3.38 | 3.64 | — | 1.08 | 30.11 | 2.54 |
| $C_2H_6$ | 9.69 | — | 9.33 | 14.02 | 1.70 | 11.86 | 8.20 | 1.49 | — | 2.16 | 14.68 | 1.03 |
| $C_3H_8$ | 4.43 | — | 1.12 | 2.21 | 0.34 | 1.42 | 4.25 | 0.17 | — | 0.79 | 2.42 | 0.12 |
| $C_4H_{10}$ | 0.19 | — | 0.01 | 0.03 | 0.01 | 0.02 | 0.19 | — | — | 0.02 | 0.03 | — |
| $C_5H_{12}$ | 0.19 | — | 0.01 | 0.01 | 0.01 | 0.01 | 0.19 | — | — | 0.01 | 0.02 | — |
| $C_6H_{14}$ | 1.29 | — | trace | 0.02 | 0.01 | 0.01 | 1.29 | — | — | 0.02 | 0.03 | — |
| $N_2$ | 0.28 | — | 1.44 | 1.84 | 0.10 | 1.82 | 0.05 | 0.22 | — | 0.02 | 1.78 | 0.15 |
| Oil | 0.00 | 100.00 | 0.01 | 23.70 | 76.33 | 0.01 | 100.02 | — | — | 23.69 | 0.01 | 0.00 |
| Total | 92.28 | 100.00 | 107.66 | 170.77 | 86.45 | 141.34 | 120.39 | 17.12 | 4.58 | 29.45 | 182.39 | 11.94 |
| ppm S in oil | — | 8937 | — | 262 | 1041 | — | 75 | — | — | 262 | — | — |

TABLE IX-continued

| Line No. | 133 | 101 | 163 | 118 | 131 | 146 | 166 | 159 | 157 | 125 | 106 | 116 |
|---|---|---|---|---|---|---|---|---|---|---|---|---|
| ppm N in oil | — | 796 | — | 573 | 751 | — | 565 | — | — | 573 | — | — |
| % aromatic C | — | 35.2 | — | 13.2 | 16.4 | — | 5.1 | — | — | 13.2 | — | — |
| Temperature °C. | 40.3 | 84.1 | 40.0 | 327.7 | 327.7 | 40.5 | 40.5 | 40.5 | 40.5 | 40.4 | 40.0 | 327.8 |
| Pressure bar | 49.3 | 49.3 | 49.3 | 49.2 | 49.2 | 49.1 | 49.1 | 3.9 | 49.0 | 49.2 | 49.5 | 49.2 |

EXAMPLE 8

The plant of FIG. 4 is operated under adiabatic conditions, using the same diesel feed stock as is used in Examples 1 to 7. There is no flow in line 102 or in line 123. The inlet temperature to reactor 108 is 283.9° C., while the exit temperature in line 142 is 334.6° C. Reactor 143 is operated with an inlet temperature of 334.6° C. and an exit temperature of 341.1° C. Of the $H_2S$ in line 142 94.08% appears in the vapour in line 118, while 5.92% appears in the stream in line 131. The results are set out in Table X.

EXAMPLE 9

The same diesel oil feed is hydrotreated on a plant of the type illustrated in FIG. 2. Operation is effected under isothermal conditions with all the catalyst being at 315.6° C. The process conditions and compositions of some of the streams are set out in Table XI below. There is no flow in line 102. 92.46% of the $H_2S$ present in line 110 appears in line 118 while only 7.54% thereof passes to line 131.

TABLE X

| Line No. | 133 | 101 | 163 | 118 | 131 | 146 | 166 | 159 | 157 | 125 | 106 | 116 |
|---|---|---|---|---|---|---|---|---|---|---|---|---|
| $H_2$ | 69.20 | — | 72.08 | 91.98 | 4.92 | 91.51 | 1.80 | 11.42 | — | 0.47 | 138.76 | 8.01 |
| $H_2S$ | 0.00 | — | trace | 5.88 | 0.37 | 4.52 | 0.88 | — | 4.52 | 1.36 | 1.15 | — |
| $NH_3$ | 0.00 | — | trace | 0.14 | 0.01 | 0.09 | 0.07 | — | 0.09 | 0.05 | 0.05 | — |
| $CH_4$ | 7.01 | — | 22.39 | 30.93 | 2.53 | 29.69 | 3.31 | 3.71 | — | 1.24 | 30.87 | 2.60 |
| $C_2H_6$ | 9.69 | — | 9.59 | 14.67 | 1.68 | 12.17 | 8.17 | 1.52 | — | 2.50 | 15.29 | 1.07 |
| $C_3H_8$ | 4.43 | — | 1.12 | 2.33 | 0.33 | 1.43 | 4.25 | 0.18 | — | 0.90 | 2.53 | 0.12 |
| $C_4H_{10}$ | 0.19 | — | 0.01 | 0.03 | 0.01 | 0.01 | 0.18 | — | — | 0.02 | 0.03 | — |
| $C_5H_{12}$ | 0.19 | — | 0.01 | 0.01 | 0.01 | 0.01 | 0.18 | — | — | 0.01 | 0.01 | — |
| $C_6H_{14}$ | 1.29 | — | trace | 0.02 | 0.01 | 0.01 | 1.29 | — | — | 0.02 | 0.03 | — |
| $N_2$ | 0.28 | — | 1.45 | 1.85 | 0.01 | 1.84 | 0.05 | 0.23 | — | 0.02 | 1.80 | 0.16 |
| Oil | 0.00 | 100.00 | 0.01 | 26.65 | 73.36 | 0.01 | 100.01 | — | — | 26.64 | 0.01 | 0.00 |
| Total | 92.28 | 100.00 | 106.66 | 174.49 | 83.24 | 141.29 | 120.19 | 17.06 | 4.61 | 33.23 | 190.53 | 11.96 |
| ppm S in oil | — | 8937 | — | 151 | 744 | — | 111 | — | — | 151 | — | — |
| ppm N in oil | — | 796 | — | 561 | 684 | — | 576 | — | — | 561 | — | — |
| % aromatic C | — | 35.2 | — | 8.1 | 9.8 | — | 4.9 | — | — | 8.1 | — | — |
| Temperature °C. | 40.3 | 84.1 | 40.0 | 334.6 | 332.9 | 40.5 | 40.5 | 40.5 | 40.5 | 40.4 | 40.0 | 334.7 |
| Pressure bar | 49.3 | 49.3 | 49.3 | 49.2 | 49.2 | 49.1 | 49.1 | 3.9 | 49.0 | 49.2 | 49.5 | 49.2 |

TABLE XI

| Line No. | 133 | 101 | 163 | 118 | 131 | 146 | 166 | 159 | 157 | 125 | 106 | 116 | 123 |
|---|---|---|---|---|---|---|---|---|---|---|---|---|---|
| $H_2$ | 69.20 | — | 75.02 | 97.06 | 5.39 | 96.80 | 1.81 | 13.44 | — | 0.26 | 127.44 | 8.34 | 0.03 |
| $H_2S$ | 0.00 | — | trace | 5.31 | 0.45 | 4.55 | 0.80 | — | 4.55 | 0.76 | 0.96 | — | 0.08 |
| $NH_3$ | 0.00 | — | trace | 0.07 | 0.01 | 0.05 | 0.06 | — | 0.05 | 0.02 | 0.04 | — | 0.00 |
| $CH_4$ | 7.01 | — | 20.98 | 27.68 | 2.52 | 27.07 | 3.26 | 3.76 | — | 0.61 | 27.81 | 2.33 | 0.07 |
| $C_2H_6$ | 9.69 | — | 9.13 | 13.12 | 1.81 | 11.78 | 8.05 | 1.63 | — | 1.34 | 13.78 | 1.01 | 0.15 |
| $C_3H_8$ | 4.43 | — | 1.20 | 2.10 | 0.38 | 1.55 | 4.21 | 0.21 | — | 0.56 | 2.29 | 0.33 | 0.06 |
| $C_4H_{10}$ | 0.18 | — | 0.01 | 0.03 | 0.01 | 0.01 | 0.18 | — | — | 0.01 | 0.03 | — | 0.00 |
| $C_5H_{12}$ | 0.18 | — | 0.01 | 0.01 | 0.01 | 0.01 | 0.18 | — | — | 0.01 | 0.01 | — | 0.00 |
| $C_6H_{14}$ | 1.29 | — | trace | 0.02 | 0.01 | 0.01 | 1.29 | — | — | 0.02 | 0.03 | — | 0.00 |
| $N_2$ | 0.28 | — | 1.29 | 1.67 | 0.10 | 1.66 | 0.05 | 0.23 | — | 0.01 | 1.63 | 0.14 | 0.00 |
| Oil | 0.00 | 100.00 | 0.01 | 17.99 | 83.81 | 0.01 | 100.00 | — | — | 17.97 | 0.01 | 0.00 | 2.00 |
| Total | 92.26 | 100.00 | 107.67 | 165.06 | 94.49 | 143.50 | 119.89 | 19.14 | 4.60 | 21.57 | 174.03 | 11.95 | 2.40 |
| ppm S in oil | — | 8937 | — | 156 | 1395 | — | 184 | — | — | 156 | — | — | 156 |
| ppm N in oil | — | 796 | — | 558 | 789 | — | 630 | — | — | 558 | — | — | 558 |
| % aromatic C | — | 35.2 | — | 16.9 | 24.0 | — | 6.5 | — | — | 16.9 | — | — | 16.9 |
| Temperature °C. | 40.3 | 84.1 | 40.0 | 305.0 | 314.1 | 40.5 | 40.5 | 40.5 | 40.5 | 40.4 | 40.6 | 315.6 | 40.6 |
| Pressure bar | 49.3 | 49.3 | 49.3 | 49.2 | 49.2 | 49.1 | 49.1 | 3.9 | 49.0 | 49.2 | 49.5 | 49.2 | 49.2 |

EXAMPLE 10

The procedure of Example 9 is repeated except that the plant of FIG. 3 is used. Isothermal conditions are used with all the catalyst at 315.6° C. Again there is no flow in line 102 but there is flow in line 123. The corresponding results are given in Table XII. 92.32% of the $H_2S$ present in line 139 appears in line 118 while only 7.68% thereof passes into line 131.

EXAMPLE 12

The diesel feedstock of Table II is supplied to the plant of FIG. 2, which is used under adiabatic conditions with flow in line 123. The inlet temperature to reactor 108 is 183.9° C., the exit temperature in line 110 being 317.2° C. The inlet temperature to reactor 137 is 317.2° C., while the exit temperature in line 145 is 342.2° C. Again there is no flow in line 102. 92.36% of the $H_2S$ in line 110 appears in the vapour in line 118, while only 7.64% thereof appears in line 131. The results are set out in Table XIV.

TABLE XII

| Line No. | 133 | 101 | 163 | 118 | 131 | 146 | 166 | 159 | 157 | 125 | 106 | 116 | 123 |
|---|---|---|---|---|---|---|---|---|---|---|---|---|---|
| $H_2$ | 69.20 | — | 73.93 | 95.60 | 5.32 | 95.34 | 1.81 | 13.19 | — | 0.26 | 135.47 | 8.21 | 0.03 |
| $H_2S$ | 0.00 | — | trace | 5.41 | 0.45 | 4.63 | 0.68 | — | 4.63 | 0.78 | 0.86 | — | 0.09 |
| $NH_3$ | 0.00 | — | trace | 0.09 | 0.01 | 0.07 | 0.05 | — | 0.07 | 0.02 | 0.03 | — | 0.00 |
| $CH_4$ | 7.01 | — | 21.57 | 28.44 | 2.59 | 27.81 | 3.17 | 3.85 | — | 0.63 | 28.58 | 2.18 | 0.07 |
| $C_2H_6$ | 9.69 | — | 9.55 | 13.74 | 1.90 | 12.32 | 7.98 | 1.70 | — | 1.42 | 14.43 | 1.06 | 0.16 |
| $C_3H_8$ | 4.43 | — | 1.26 | 2.21 | 0.40 | 1.63 | 4.20 | 0.22 | — | 0.59 | 2.41 | 0.14 | 0.07 |
| $C_4H_{10}$ | 0.18 | — | 0.01 | 0.03 | 0.01 | 0.01 | 0.18 | — | — | 0.02 | 0.03 | — | 0.00 |
| $C_5H_{12}$ | 0.18 | — | 0.01 | 0.01 | 0.00 | 0.00 | 0.18 | — | — | 0.01 | 0.01 | — | 0.00 |
| $C_6H_{14}$ | 1.29 | — | trace | 0.02 | 0.01 | 0.00 | 1.29 | — | — | 0.02 | 0.03 | — | 0.00 |
| $N_2$ | 0.28 | — | 1.30 | 1.69 | 0.10 | 1.68 | 0.04 | 0.23 | — | 0.01 | 1.65 | 0.14 | 0.00 |
| Oil | 0.00 | 100.00 | 0.01 | 18.01 | 83.74 | 0.01 | 100.00 | — | — | 10.06 | 0.01 | 0.00 | 2.01 |
| Total | 92.26 | 100.00 | 107.64 | 165.25 | 94.53 | 143.50 | 119.54 | 19.19 | 4.70 | 21.82 | 183.51 | 11.91 | 2.42 |
| ppm S in oil | — | 8937 | — | 87 | 1006 | — | 253 | — | — | 87 | — | — | 87 |
| ppm N in oil | — | 796 | — | 528 | 745 | — | 634 | — | — | 528 | — | — | 528 |
| % aromatic C | — | 35.2 | — | 11.2 | 35.8 | — | 6.2 | — | — | 11.2 | — | — | 11.2 |
| Temperature °C. | 40.3 | 84.1 | 40.6 | 305.0 | 314.1 | 40.5 | 40.5 | 40.6 | 40.5 | 40.6 | 40.6 | 315.6 | 40.6 |
| Pressure bar | 49.3 | 49.3 | 49.1 | 49.2 | 49.2 | 49.1 | 49.1 | 3.9 | 49.0 | 49.2 | 49.5 | 49.2 | 49.2 |

EXAMPLE 11

The procedure of Example 9 is repeated except that the plant of FIG. 4 is used. Isothermal conditions are used and there is flow in line 123 as set out in Table XIII. Again there is no flow in line 102. The corresponding results are given in Table XIII. 92.36% of the $H_2S$ in line 142 appears in line 118 while only 7.64% thereof appears in line 131.

TABLE XIII

| Line No. | 133 | 101 | 163 | 118 | 131 | 146 | 166 | 159 | 157 | 125 | 106 | 116 | 123 |
|---|---|---|---|---|---|---|---|---|---|---|---|---|---|
| $H_2$ | 69.20 | — | 73.52 | 95.31 | 5.28 | 95.05 | 1.82 | 13.36 | — | 0.26 | 141.49 | 8.17 | 0.03 |
| $H_2S$ | 0.00 | — | trace | 5.44 | 0.45 | 4.65 | 0.60 | — | 4.65 | 0.79 | 0.77 | — | 0.09 |
| $NH_3$ | 0.00 | — | trace | 0.10 | 0.01 | 0.09 | 0.03 | — | 0.09 | 0.02 | 0.02 | — | 0.00 |
| $CH_4$ | 7.01 | — | 21.67 | 28.65 | 2.61 | 27.01 | 3.07 | 3.95 | — | 0.63 | 28.78 | 2.40 | 0.07 |
| $C_2H_6$ | 9.69 | — | 9.85 | 14.22 | 1.96 | 12.75 | 7.94 | 1.78 | — | 1.48 | 14.89 | 1.10 | 0.16 |
| $C_3H_8$ | 4.43 | — | 1.30 | 2.28 | 0.41 | 1.68 | 4.19 | 0.24 | — | 0.60 | 2.49 | 0.14 | 0.07 |
| $C_4H_{10}$ | 0.18 | — | 0.01 | 0.03 | 0.01 | 0.02 | 0.19 | — | — | 0.02 | 0.03 | — | 0.00 |
| $C_5H_{12}$ | 0.18 | — | 0.01 | 0.01 | 0.00 | 0.00 | 0.19 | — | — | 0.01 | 0.01 | — | 0.00 |
| $C_6H_{14}$ | 1.29 | — | trace | 0.02 | 0.01 | 0.00 | 1.29 | — | — | 0.02 | 0.03 | — | 0.00 |
| $N_2$ | 0.28 | — | 1.29 | 1.68 | 0.10 | 1.67 | 0.03 | 0.24 | — | 0.01 | 1.63 | 0.14 | 0.00 |
| Oil | 0.00 | 100.00 | 0.01 | 18.16 | 83.68 | 0.01 | 100.00 | — | — | 18.14 | 0.01 | 0.00 | 2.02 |
| Total | 92.26 | 100.00 | 107.66 | 165.90 | 94.52 | 142.93 | 119.35 | 19.57 | 4.74 | 21.98 | 190.15 | 11.95 | 2.44 |
| ppm S in oil | — | 8937 | — | 71 | 821 | — | 367 | — | — | 71 | — | — | 71 |
| ppm N in oil | — | 796 | — | 463 | 717 | — | 639 | — | — | 463 | — | — | 463 |
| % aromatic C | — | 35.2 | — | 7.4 | 10.4 | — | 6.2 | — | — | 7.4 | — | — | 7.4 |
| Temperature ° C. | 40.3 | 84.1 | 40.6 | 305.0 | 314.1 | 40.6 | 40.6 | 40.6 | 40.5 | 40.6 | 40.6 | 315.6 | 40.6 |
| Pressure bar | 49.3 | 49.3 | 49.3 | 49.2 | 49.2 | 49.1 | 49.1 | 3.9 | 49.0 | 49.2 | 49.5 | 49.2 | 49.2 |

TABLE XIV

| Line No. | 133 | 101 | 163 | 118 | 131 | 146 | 166 | 159 | 157 | 125 | 106 | 116 | 123 |
|---|---|---|---|---|---|---|---|---|---|---|---|---|---|
| $H_2$ | 69.20 | — | 73.79 | 93.96 | 5.32 | 93.64 | 1.78 | 11.65 | — | 0.33 | 121.63 | 8.20 | 0.04 |
| $H_2S$ | 0.00 | — | trace | 5.44 | 0.45 | 4.43 | 0.99 | — | 4.43 | 0.91 | 1.15 | — | 0.10 |
| $NH_3$ | 0.00 | — | trace | 0.09 | 0.01 | 0.06 | 0.11 | — | 0.06 | 0.02 | 0.07 | — | 0.00 |
| $CH_4$ | 7.01 | — | 22.20 | 28.97 | 2.66 | 28.17 | 3.51 | 3.50 | — | 0.80 | 29.09 | 2.47 | 0.09 |
| $C_2H_6$ | 9.69 | — | 9.07 | 13.12 | 1.81 | 11.51 | 8.25 | 1.43 | — | 1.61 | 13.76 | 1.01 | 0.18 |
| $C_3H_8$ | 4.43 | — | 1.14 | 2.08 | 0.37 | 1.45 | 4.25 | 0.18 | — | 0.63 | 2.26 | 0.13 | 0.07 |
| $C_4H_{10}$ | 0.18 | — | 0.01 | 0.03 | 0.01 | 0.01 | 0.18 | — | — | 0.02 | 0.03 | — | 0.00 |
| $C_5H_{12}$ | 0.18 | — | 0.01 | 0.01 | 0.00 | 0.00 | 0.18 | — | — | 0.01 | 0.01 | — | 0.00 |
| $C_6H_{14}$ | 1.29 | — | trace | 0.02 | 0.01 | 0.00 | 1.29 | — | — | 0.02 | 0.03 | — | 0.00 |
| $N_2$ | 0.28 | — | 1.42 | 1.81 | 0.11 | 1.80 | 0.04 | 0.22 | — | 0.01 | 1.77 | 0.16 | 0.00 |
| Oil | 0.00 | 100.00 | 0.01 | 18.29 | 83.55 | 0.01 | 100.00 | — | — | 18.29 | 0.01 | 0.00 | 2.03 |
| Total | 92.26 | 100.00 | 107.65 | 163.82 | 94.30 | 141.08 | 120.58 | 16.98 | 4.49 | 22.65 | 169.81 | 11.97 | 2.52 |
| ppm S in oil | — | 8937 | — | 211 | 1716 | — | 74 | — | — | 211 | — | — | 211 |
| ppm N in oil | — | 796 | — | 568 | 799 | — | 556 | — | — | 568 | — | — | 568 |
| % aromatic C | — | 35.2 | — | 18.4 | 26.0 | — | 5.1 | — | — | 18.4 | — | — | 18.4 |
| Temperature ° C. | 40.3 | 84.1 | 40.6 | 306.4 | 315.7 | 40.6 | 40.6 | 40.6 | 40.5 | 40.6 | 40.6 | 317.2 | 40.6 |
| Pressure bar | 49.3 | 49.3 | 49.3 | 49.2 | 49.2 | 49.1 | 49.1 | 3.9 | 49.0 | 49.2 | 49.5 | 49.2 | 49.2 |

EXAMPLES 13 to 15

The procedure of Example 12 is repeated except that the flow rate in line 123 is varied. The results are set out in Table XV below.

TABLE XV

| Example No. | 13 | 14 | 15 |
|---|---|---|---|
| Flow rate in line 123 (%*) | 5 | 10 | 20 |
| Line 118 | | | |
| ppm S | 308 | 211 | 176 |
| ppm N | 595 | 568 | 510 |
| % aromatic C | 20.3 | 18.4 | 15.8 |
| Line 131 | | | |
| ppm S | 1728 | 1716 | 1682 |
| ppm N | 800 | 799 | 801 |
| % aromatic C | 26.0 | 26.0 | 25.9 |
| Line 166 | | | |
| ppm S | 83 | 73 | 68 |
| ppm N | 554 | 556 | 556 |
| % aromatic C | 5.2 | 5.1 | 4.6 |

TABLE XV-continued

| Temperatures ° C. | | | |
|---|---|---|---|
| line 107 | 283.9 | 283.9 | 283.9 |
| line 110 | 317.2 | 317.2 | 317.1 |
| line 118 | 311.5 | 306.4 | 297.6 |
| line 126 | 315.9 | 315.7 | 315.0 |
| line 131 | 317.2 | 317.2 | 317.1 |
| line 145 | 342.3 | 342.2 | 342.1 |

*as a percentage of the flow rate in line 122.

EXAMPLE 16

In this Example the plant of FIG. 3 is operated under adiabatic conditions using the diesel feedstock of Table II and with flow in line 123. There is no flow in line 102. An inlet temperature of 283.9° C. is used to reactor 108, the exit temperature from reactor 137 being 327.7° C. The inlet temperature to reactor 140 is 327.7° C. and the exit temperature from reactor 143 is 341.1° C. The $H_2S$ in line 139 is split 92.66% to the vapour in line 118 and 7.34% in line 131. The results are set out in Table XVI.

TABLE XVI

| Line No. | 133 | 101 | 163 | 118 | 131 | 146 | 166 | 159 | 157 | 125 | 106 | 116 | 123 |
|---|---|---|---|---|---|---|---|---|---|---|---|---|---|
| $H_2$ | 69.20 | — | 72.34 | 92.02 | 5.26 | 91.64 | 1.79 | 11.27 | — | 0.38 | 131.26 | 8.20 | 0.04 |
| $H_2S$ | 0.00 | — | trace | 5.68 | 0.43 | 4.56 | 0.86 | — | 4.56 | 1.12 | 1.07 | — | 0.12 |
| $NH_3$ | 0.00 | — | trace | 0.11 | 0.01 | 0.08 | 0.09 | — | 0.08 | 0.03 | 0.06 | — | 0.00 |
| $CH_4$ | 7.01 | — | 23.12 | 30.28 | 2.72 | 29.29 | 3.41 | 3.60 | — | 0.99 | 30.33 | 2.47 | 0.11 |
| $C_2H_6$ | 9.69 | — | 9.53 | 14.08 | 1.82 | 12.07 | 8.20 | 1.48 | — | 2.01 | 14.64 | 1.01 | 0.22 |
| $C_3H_8$ | 4.43 | — | 1.18 | 2.25 | 0.37 | 1.49 | 4.25 | 0.18 | — | 0.77 | 2.41 | 0.13 | 0.09 |
| $C_4H_{10}$ | 0.18 | — | 0.01 | 0.03 | 0.01 | 0.01 | 0.18 | — | — | 0.02 | 0.03 | — | 0.00 |
| $C_5H_{12}$ | 0.18 | — | 0.01 | 0.01 | 0.00 | 0.00 | 0.18 | — | — | 0.01 | 0.01 | — | 0.00 |
| $C_6H_{14}$ | 1.29 | — | trace | 0.02 | 0.01 | 0.00 | 1.29 | — | — | 0.02 | 0.03 | — | 0.00 |
| $N_2$ | 0.20 | — | 1.46 | 1.86 | 0.11 | 1.85 | 0.05 | 0.23 | — | 0.01 | 1.81 | 0.16 | 0.00 |
| Oil | 0.00 | 100.00 | 0.01 | 21.64 | 80.54 | 0.01 | 99.99 | — | — | 21.63 | 0.01 | 0.00 | 2.40 |
| Total | 92.26 | 100.00 | 107.66 | 167.98 | 91.28 | 141.00 | 120.29 | 16.76 | 4.64 | 26.99 | 181.66 | 11.97 | 3.00 |
| ppm S in oil | — | 8937 | — | 106 | 1031 | — | 62 | — | — | 106 | — | — | 106 |
| ppm N in oil | — | 796 | — | 552 | 749 | — | 565 | — | — | 552 | — | — | 552 |
| % aromatic C | — | 35.2 | — | 12.3 | 16.6 | — | 4.8 | — | — | 12.3 | — | — | 12.3 |
| Temperature ° C. | 40.3 | 84.1 | 40.6 | 316.2 | 325.9 | 40.6 | 40.6 | 40.6 | 40.5 | 40.6 | 40.6 | 126.0 | 40.6 |
| Pressure bar | 49.1 | 49.1 | 49.1 | 49.2 | 49.2 | 49.1 | 49.1 | 3.9 | 49.0 | 49.2 | 49.5 | 49.2 | 49.2 |

EXAMPLE 17

The plant of FIG. 4 is operated under adiabatic conditions, using the diesel feedstock of Table II. There is no flow in line 102 but there is flow in line 123. The inlet temperature to reactor 108 is 283.9° C., while the exit temperature in line 142 is 334.7° C. Reactor 143 is operated with an inlet temperature of 334.7° C. and an exit temperature of 340.1° C. Of the $H_2S$ in line 142 93.45% appears in the vapour in line 118, while 6.55% appears in the stream in line 131. The results are set out in Table XVII.

TABLE XVII

| Line No. | 133 | 101 | 163 | 118 | 131 | 146 | 166 | 159 | 157 | 125 | 106 | 116 | 123 |
|---|---|---|---|---|---|---|---|---|---|---|---|---|---|
| $H_2$ | 69.20 | — | 71.72 | 91.41 | 5.23 | 90.98 | 1.80 | 11.30 | — | 0.43 | 138.52 | 7.98 | 0.05 |
| $H_2S$ | 0.00 | — | trace | 5.85 | 0.41 | 4.60 | 0.81 | — | 4.60 | 1.25 | 1.05 | — | 0.14 |
| $NH_3$ | 0.00 | — | trace | 0.14 | 0.01 | 0.09 | 0.07 | — | 0.09 | 0.05 | 0.05 | — | 0.01 |
| $CH_4$ | 7.01 | — | 23.47 | 30.89 | 2.71 | 29.76 | 3.31 | 3.71 | — | 1.13 | 30.89 | 2.61 | 0.11 |
| $C_2H_6$ | 9.69 | — | 9.79 | 14.72 | 1.82 | 12.40 | 8.15 | 1.54 | — | 2.32 | 15.23 | 1.08 | 0.26 |
| $C_3H_8$ | 4.43 | — | 1.18 | 2.38 | 0.36 | 1.51 | 4.24 | 0.19 | — | 0.87 | 2.52 | 0.14 | 0.10 |
| $C_4H_{10}$ | 0.18 | — | 0.01 | 0.03 | 0.01 | 0.02 | 0.19 | — | — | 0.02 | 0.03 | — | 0.00 |
| $C_5H_{12}$ | 0.18 | — | 0.01 | 0.01 | 0.00 | 0.00 | 0.19 | — | — | 0.01 | 0.01 | — | 0.00 |
| $C_6H_{14}$ | 1.29 | — | trace | 0.02 | 0.01 | 0.00 | 1.29 | — | — | 0.02 | 0.03 | — | 0.00 |
| $N_2$ | 0.20 | — | 1.46 | 1.85 | 0.11 | 1.84 | 0.07 | 0.22 | — | 0.01 | 1.80 | 0.16 | 0.00 |
| Oil | 0.00 | 100.00 | 0.01 | 24.17 | 78.25 | 0.01 | 100.01 | — | — | 24.15 | 0.01 | 0.00 | 2.68 |
| Total | 92.26 | 100.00 | 107.65 | 171.47 | 88.92 | 141.21 | 120.13 | 16.96 | 4.69 | 30.26 | 190.14 | 11.97 | 1.16 |
| ppm S in oil | — | 8937 | — | 79 | 719 | — | 113 | — | — | 79 | — | — | 79 |
| ppm N in oil | — | 776 | — | 514 | 671 | — | 555 | — | — | 514 | — | — | 514 |
| % aromatic C | — | 15.2 | — | 7.5 | 9.8 | — | 4.8 | — | — | 7.5 | — | — | 7.5 |
| Temperature ° C. | 40.3 | 84.1 | 40.6 | 306.4 | 315.7 | 40.6 | 40.6 | 40.6 | 40.5 | 40.6 | 40.6 | 334.7 | 40.6 |
| Pressure bar | 49.3 | 49.3 | 49.3 | 49.2 | 49.2 | 49.1 | 49.1 | 3.9 | 49.0 | 49.2 | 49.5 | 49.2 | 49.2 |

EXAMPLE 18 (COMPARATIVE EXAMPLE)

The gas oil feedstock of Table II is supplied to a plant of the type illustrated in FIG. 1. The plant is operated isothermally, the catalyst beds being maintained at 367.8° C. The operating conditions and molar compositions of the more important streams are set out in Table XVIII below.

TABLE XVIII

| Line No. | 8 | 1 | 9 | 17 | 30 | 29 | 37 | 34 |
|---|---|---|---|---|---|---|---|---|
| $H_2$ | 347.96 | — | 153.17 | 404.35 | 373.70 | 0.82 | 220.53 | — |
| $H_2S$ | 0.00 | — | trace | 20.48 | 14.01 | 10.69 | — | 14.01 |
| $NH_3$ | 0.00 | — | trace | 1.78 | 1.15 | 1.41 | — | 1.15 |
| $CH_4$ | 35.26 | — | 19.59 | 54.86 | 47.80 | 7.06 | 28.21 | — |
| $C_2H_6$ | 48.71 | — | 16.93 | 65.64 | 41.30 | 24.34 | 24.37 | — |
| $C_3H_8$ | 22.27 | — | 4.08 | 26.35 | 9.97 | 16.39 | 5.88 | — |
| $C_4H_{10}$ | 0.93 | — | 0.07 | 1.00 | 0.18 | 0.82 | 0.11 | — |
| $C_5H_{12}$ | 0.93 | — | 0.03 | 0.96 | 0.07 | 0.89 | 0.04 | — |
| $C_6H_{14}$ | 6.50 | — | 0.08 | 6.58 | 0.20 | 6.38 | 0.12 | — |
| $N_2$ | 1.39 | — | 0.90 | 2.29 | 2.19 | 0.10 | 1.29 | — |
| Oil | 0.00 | 100.00 | 0.01 | 100.01 | trace | 100.00 | — | — |
| Total | 463.95 | 100.00 | 194.86 | 684.30 | 490.57 | 176.90 | 280.55 | 15.16 |
| ppm S in oil | — | 21736 | — | 4659 | — | 1078 | — | — |
| ppm N in oil | — | 1182 | — | 541 | — | 253 | — | — |
| % aromatic C | — | 38.2 | — | 30.0 | — | 28.1 | — | — |
| Temperature ° C. | 40.3 | 84.1 | 40 | 367.8 | 40.5 | 40.5 | 40.5 | 40.5 |
| Pressure bar | 104.4 | 104.6 | 104.6 | 104.2 | 104.0 | 103.8 | 3.9 | 103.5 |

EXAMPLE 19 (COMPARATIVE EXAMPLE)

The procedure of Example 18 is repeated except that the plant is operated adiabatically. The same gas oil feed is used. The conditions and molar compositions of the most important streams in the plant are set out in Table XIX below. The inlet temperature in line 5 is 326.7° C., the temperature in lines 15 and 19 is 362.4° C. and that in line 25 is 378.6° C.

TABLE XIX

| Line No. | 8 | 1 | 9 | 17 | 30 | 29 | 37 | 34 |
|---|---|---|---|---|---|---|---|---|
| $H_2$ | 347.96 | — | 153.55 | 423.51 | 378.20 | 8.79 | 224.65 | — |
| $H_2S$ | 0.00 | — | trace | 16.44 | 13.70 | 10.33 | — | 13.70 |
| $NH_3$ | 0.00 | — | trace | 1.12 | 1.06 | 1.28 | — | 1.06 |
| $CH_4$ | 35.26 | — | 19.35 | 54.61 | 47.66 | 6.95 | 28.31 | — |
| $C_2H_6$ | 48.71 | — | 16.81 | 65.52 | 41.41 | 24.12 | 24.59 | — |
| $C_3H_8$ | 22.27 | — | 4.07 | 26.34 | 10.03 | 16.31 | 5.96 | — |
| $C_4H_{10}$ | 0.93 | — | 0.07 | 1.00 | 0.18 | 0.82 | 0.11 | — |
| $C_5H_{12}$ | 0.93 | — | 0.03 | 0.96 | 0.07 | 0.88 | 0.04 | — |
| $C_6H_{14}$ | 6.50 | — | 0.08 | 6.57 | 0.20 | 6.38 | 0.12 | — |
| $N_2$ | 1.39 | — | 0.90 | 2.28 | 2.18 | 0.10 | 1.30 | — |
| Oil | 0.00 | 100.00 | 0.01 | 99.99 | trace | 99.99 | — | — |
| Total | 463.95 | 100.00 | 194.86 | 698.34 | 494.69 | 175.95 | 285.08 | 14.76 |
| ppm S in oil | — | 21736 | — | 8067 | — | 1647 | — | — |
| ppm N in oil | — | 1182 | — | 783 | — | 334 | — | — |
| % aromatic C | — | 38.2 | — | 31.3 | — | 28.5 | — | — |
| Temperature ° C. | 40.3 | 84.1 | 40.0 | 362.4 | 40.5 | 40.5 | 40.5 | 40.5 |
| Pressure bar | 104.4 | 104.6 | 104.6 | 104.2 | 104.0 | 103.8 | 3.9 | 103.5 |

EXAMPLE 20

The same gas oil feed is hydrotreated in a plant of the type illustrated in FIG. 2 in which 25% of the catalyst is placed in the first of the hydrotreatment zones and 75% thereof in the second hydrotreatment zone. Operation is effected under isothermal conditions with all the catalyst being at 367.8° C. The process conditions and compositions of some of the streams are set out in Table XX below. There is no flow in line 102 or in line 123. 92.27% of the $H_2S$ present in line 110 appears in line 118 while only 7.73% thereof passes to line 131.

EXAMPLE 21

The procedure of Example 20 is repeated except that the plant of FIG. 3 is used. Isothermal conditions are used with all the catalyst at 367.8° C. Again there is no flow in line 102 and no flow in line 123. The corresponding results are given in Table XXI. 92.41% of the $H_2S$ present in line 139 appears in line 118 while only 7.59% thereof passes into line 131.

TABLE XX

| Line No. | 133 | 101 | 163 | 118 | 131 | 146 | 166 | 159 | 157 | 125 | 106 | 116 |
|---|---|---|---|---|---|---|---|---|---|---|---|---|
| $H_2$ | 347.96 | — | 133.13 | 362.40 | 19.67 | 362.12 | 8.66 | 210.83 | — | 0.28 | 427.76 | 18.15 |
| $H_2S$ | 0.00 | — | trace | 20.17 | 1.69 | 19.67 | 4.95 | — | 19.67 | 0.49 | 7.47 | 0.00 |
| $NH_3$ | 0.00 | — | trace | 1.79 | 0.16 | 1.72 | 0.87 | — | 1.72 | 0.07 | 0.82 | 0.00 |
| $CH_4$ | 35.26 | — | 18.16 | 49.56 | 4.06 | 49.32 | 6.54 | 28.72 | — | 0.24 | 51.15 | 2.47 |
| $C_2H_6$ | 48.71 | — | 15.67 | 43.43 | 5.19 | 42.62 | 23.90 | 24.81 | — | 0.81 | 46.49 | 2.14 |
| $C_3H_8$ | 22.27 | — | 3.61 | 10.33 | 1.62 | 9.81 | 16.56 | 5.71 | — | 0.52 | 11.46 | 0.49 |
| $C_4H_{10}$ | 0.93 | — | 0.06 | 0.18 | 0.04 | 0.16 | 0.84 | 0.09 | — | 0.02 | 0.21 | 0.01 |
| $C_5H_{12}$ | 0.93 | — | 0.02 | 0.07 | 0.02 | 0.05 | 0.90 | 0.03 | — | 0.02 | 0.08 | tr |
| $C_6H_{14}$ | 6.50 | — | 0.03 | 0.17 | 0.06 | 0.08 | 6.45 | 0.05 | — | 0.09 | 0.22 | tr |
| $N_2$ | 1.39 | — | 0.82 | 2.24 | 0.13 | 2.24 | 0.09 | 1.30 | — | tr | 2.26 | 0.11 |
| Oil | 0.00 | 100.00 | 0.01 | 3.28 | 96.72 | tr | 100.00 | — | — | 3.28 | 0.01 | 0.00 |
| Total | 461.95 | 100.00 | 171.51 | 493.62 | 129.36 | 487.79 | 169.76 | 271.54 | 21.39 | 5.82 | 547.93 | 23.37 |
| ppm S in oil | — | 21736 | — | 10160 | 9773 | — | 1141 | — | — | 10160 | — | — |
| ppm N in oil | — | 1182 | — | 462 | 787 | — | 238 | — | — | 462 | — | — |
| % aromatic C | — | 38.2 | — | 23.8 | 33.8 | — | 25.2 | — | — | 23.8 | — | — |
| Temperature ° C. | 40.3 | 84.1 | 40.0 | 367.8 | 365.1 | 40.5 | 40.5 | 40.5 | 40.5 | 40.4 | 40.5 | 40.5 |
| Pressure bar | 104.4 | 104.6 | 104.6 | 104.2 | 104.2 | 104.0 | 103.8 | 3.9 | 103.5 | 103.8 | 104.6 | 104.2 |

TABLE XXI

| Line No. | 133 | 101 | 163 | 118 | 131 | 146 | 166 | 159 | 157 | 125 | 106 | 116 |
|---|---|---|---|---|---|---|---|---|---|---|---|---|
| $H_2$ | 147.96 | — | 132.90 | 168.73 | 19.73 | 368.43 | 8.49 | 217.41 | — | 0.30 | 470.56 | 18.12 |
| $H_2S$ | 0.00 | — | trace | 23.00 | 1.89 | 22.41 | 2.47 | — | 22.41 | 0.59 | 4.10 | 0.00 |

TABLE XXI-continued

| Line No. | 133 | 101 | 163 | 118 | 131 | 146 | 166 | 159 | 157 | 125 | 106 | 116 |
|---|---|---|---|---|---|---|---|---|---|---|---|---|
| $NH_3$ | 0.00 | — | trace | 2.20 | 0.19 | 2.12 | 0.51 | — | 2.12 | 0.09 | 0.53 | 0.00 |
| $CH_4$ | 35.26 | — | 17.92 | 49.94 | 4.02 | 49.68 | 5.94 | 29.32 | — | 0.25 | 51.52 | 2.44 |
| $C_2H_6$ | 48.71 | — | 15.98 | 45.18 | 5.30 | 44.30 | 22.58 | 26.14 | — | 0.89 | 48.30 | 2.15 |
| $C_3H_8$ | 22.27 | — | 3.76 | 11.00 | 1.70 | 10.42 | 16.12 | 6.15 | — | 0.58 | 12.18 | 0.51 |
| $C_4H_{10}$ | 0.93 | — | 0.06 | 0.19 | 0.04 | 0.17 | 0.83 | 0.10 | — | 0.03 | 0.22 | 0.01 |
| $C_5H_{12}$ | 0.93 | — | 0.02 | 0.07 | 0.02 | 0.05 | 0.90 | 0.03 | — | 0.02 | 0.09 | tr |
| $C_6H_{14}$ | 6.50 | — | 0.03 | 0.18 | 0.06 | 0.09 | 6.44 | 0.05 | — | 0.09 | 0.24 | tr |
| $N_2$ | 1.39 | — | 0.80 | 2.23 | 0.13 | 2.23 | 0.08 | 1.31 | — | tr | 2.25 | 0.11 |
| Oil | 0.00 | 100.00 | 0.01 | 3.46 | 95.56 | tr | 100.00 | — | — | 3.46 | 0.01 | 0.00 |
| Total | 461.95 | 100.00 | 171.48 | 506.18 | 128.64 | 499.90 | 164.38 | 280.51 | 24.53 | 6.30 | 590.00 | 23.37 |
| ppm S in oil | — | 21736 | — | 4490 | 4389 | — | 944 | — | — | 4490 | — | — |
| ppm N in oil | — | 1182 | — | 299 | 515 | — | 230 | — | — | 299 | — | — |
| % aromatic C | — | 38.2 | — | 20.6 | 29.6 | — | 27.9 | — | — | 20.6 | — | — |
| Temperature ° C. | 40.3 | 84.1 | 40.0 | 367.8 | 365.1 | 40.5 | 40.5 | 40.5 | 40.5 | 40.4 | 40.6 | 40.6 |
| Pressure bar | 104.4 | 104.6 | 104.6 | 104.2 | 104.2 | 104.0 | 103.8 | 3.9 | 103.5 | 103.8 | 104.6 | 104.2 |

EXAMPLE 22

The procedure of Example 20 is repeated except that the plant of FIG. 4 is used. Isothermal conditions are used. Again there is no flow in line 102 or in line 123. The corresponding results are given in Table XXII. 92.60% of the $H_2S$ in line 142 appears in line 118 while only 7.40% thereof appears in line 131.

TABLE XXII

| Line No. | 133 | 101 | 163 | 118 | 131 | 146 | 166 | 159 | 157 | 125 | 106 | 116 |
|---|---|---|---|---|---|---|---|---|---|---|---|---|
| $H_2$ | 347.96 | — | 133.63 | 378.62 | 19.74 | 378.32 | 8.39 | 226.46 | — | 0.30 | 484.45 | 18.22 |
| $H_2S$ | 0.00 | — | trace | 24.14 | 1.93 | 23.53 | 1.42 | — | 23.53 | 0.61 | 2.43 | 0.00 |
| $NH_3$ | 0.00 | — | trace | 2.45 | 0.21 | 2.35 | 0.29 | — | 2.35 | 0.10 | 0.31 | 0.00 |
| $CH_4$ | 35.26 | — | 17.45 | 49.64 | 3.90 | 49.39 | 5.69 | 29.57 | — | 0.25 | 51.16 | 2.38 |
| $C_2H_6$ | 48.71 | — | 15.76 | 45.50 | 5.20 | 44.61 | 22.01 | 26.71 | — | 0.89 | 48.55 | 2.15 |
| $C_3H_8$ | 22.27 | — | 3.75 | 11.68 | 1.68 | 10.60 | 15.92 | 6.35 | — | 0.58 | 12.36 | 0.51 |
| $C_4H_{10}$ | 0.93 | — | 0.06 | 0.20 | 0.04 | 0.17 | 0.83 | 0.10 | — | 0.03 | 0.23 | 0.01 |
| $C_5H_{12}$ | 0.93 | — | 0.02 | 0.07 | 0.02 | 0.05 | 0.90 | 0.03 | — | 0.02 | 0.09 | tr |
| $C_6H_{14}$ | 6.50 | — | 0.03 | 0.19 | 0.06 | 0.09 | 6.44 | 0.05 | — | 0.10 | 0.24 | tr |
| $N_2$ | 1.39 | — | 0.78 | 2.21 | 0.12 | 2.20 | 0.07 | 1.32 | — | tr | 2.22 | 0.11 |
| Oil | 0.00 | 100.00 | 0.01 | 3.49 | 96.52 | tr | 100.00 | — | — | 3.49 | 0.01 | 0.00 |
| Total | 463.95 | 100.00 | 171.49 | 517.70 | 129.42 | 511.31 | 161.97 | 290.59 | 25.88 | 6.37 | 602.05 | 23.38 |
| ppm S in oil | — | 21736 | — | 2936 | 1975 | — | 866 | — | — | 2036 | — | — |
| ppm N in oil | — | 1182 | — | 196 | 337 | — | 220 | — | — | 196 | — | — |
| % aromatic C | — | 38.2 | — | 22.0 | 31.4 | — | 30.0 | — | — | 22.0 | — | — |
| Temperature ° C. | 40.3 | 84.1 | 40.0 | 367.8 | 365.1 | 40.5 | 40.5 | 40.5 | 40.5 | 40.4 | 40.6 | 40.6 |
| Pressure bar | 104.4 | 104.6 | 104.6 | 104.2 | 104.2 | 104.0 | 103.8 | 3.9 | 103.5 | 103.8 | 104.6 | 104.2 |

EXAMPLE 23

The same gas oil feedstock of Table II is supplied to the plant of FIG. 2, which is used under adiabatic conditions. The inlet temperature to reactor 108 is 326.7° C., the exit temperature in line 110 being 347.2° C. The inlet temperature to reactor 137 is 347.2° C., while the exit temperature in line 145 is 387.3° C. Again there is no flow in line 102 or in line 123. 92.01% of the $H_2S$ in line 110 appears in the vapour in line 118 while only 7.99% thereof appears in line 131. The results are set out in Table XXIII.

TABLE XXIII

| Line No. | 133 | 101 | 163 | 118 | 131 | 146 | 166 | 159 | 157 | 125 | 106 | 116 |
|---|---|---|---|---|---|---|---|---|---|---|---|---|
| $H_2$ | 347.96 | — | 133.46 | 360.17 | 18.46 | 359.99 | 8.78 | 208.34 | — | 0.17 | 402.08 | 18.20 |
| $H_2S$ | 0.00 | — | trace | 17.51 | 1.52 | 17.23 | 7.09 | — | 17.23 | 0.28 | 10.03 | 0.00 |
| $NH_3$ | 0.00 | — | trace | 1.40 | 0.13 | 1.37 | 1.15 | — | 1.37 | 0.04 | 1.02 | 0.00 |
| $CH_4$ | 35.26 | — | 18.15 | 49.11 | 3.96 | 48.96 | 6.93 | 28.33 | — | 0.15 | 50.60 | 2.48 |
| $C_2H_6$ | 48.71 | — | 15.40 | 42.06 | 5.12 | 41.55 | 24.67 | 24.04 | — | 0.51 | 45.08 | 2.10 |
| $C_3H_8$ | 22.27 | — | 3.52 | 9.82 | 1.62 | 9.50 | 16.77 | 5.49 | — | 0.33 | 10.96 | 0.48 |
| $C_4H_{10}$ | 0.93 | — | 0.06 | 0.17 | 0.04 | 0.15 | 0.84 | 0.09 | — | 0.01 | 0.20 | 0.01 |
| $C_5H_{12}$ | 0.93 | — | 0.02 | 0.06 | 0.02 | 0.05 | 0.90 | 0.03 | — | 0.01 | 0.08 | tr |
| $C_6H_{14}$ | 6.50 | — | 0.04 | 0.16 | 0.06 | 0.10 | 6.44 | 0.06 | — | 0.06 | 0.21 | tr |
| $N_2$ | 1.39 | — | 0.83 | 2.25 | 0.12 | 2.24 | 0.09 | 1.30 | — | tr | 2.25 | 0.11 |

TABLE XXIII-continued

| Line No. | 133 | 101 | 163 | 118 | 131 | 146 | 166 | 159 | 157 | 125 | 106 | 116 |
|---|---|---|---|---|---|---|---|---|---|---|---|---|
| Oil | 0.00 | 100.00 | 0.01 | 2.13 | 97.87 | tr | 100.00 | — | — | 2.13 | 0.01 | 0.00 |
| Total | 463.95 | 100.00 | 171.49 | 484.84 | 128.92 | 481.14 | 173.66 | 267.68 | 18.60 | 3.69 | 522.52 | 23.38 |
| ppm S in oil | — | 21736 | — | 15300 | 14276 | — | 1402 | — | — | 15300 | — | — |
| ppm N in oil | — | 1182 | — | 555 | 1009 | — | 267 | — | — | 555 | — | — |
| % aromatic C | — | 38.2 | — | 23.3 | 34.8 | — | 24.1 | — | — | 23.3 | — | — |
| Temperature ° C. | 40.3 | 84.1 | 40.0 | 347.3 | 344.7 | 40.5 | 40.5 | 40.5 | 40.5 | 40.4 | 40.6 | 40.6 |
| Pressure bar | 104.4 | 104.6 | 104.6 | 104.2 | 104.2 | 104.0 | 103.8 | 3.9 | 103.5 | 103.8 | 104.6 | 104.2 |

EXAMPLE 24

In this Example the plant of FIG. 3 is operated under adiabatic conditions using the gas oil feedstock of Table II. There is no flow in line 102 or in line 123. An inlet temperature of 326.7° C. is used to reactor 108, the exit temperature from reactor 137 being 366.2° C. The inlet temperature to reactor 140 is 366.1° C. and the exit temperature from reactor 143 is 384.6° C. The $H_2S$ in line 139 is split 92.34% to the vapour in line 118 and 7.66% in 131. The results are set out in Table XXIV.

TABLE XXIV

| Line No. | 133 | 101 | 163 | 118 | 131 | 146 | 166 | 159 | 157 | 125 | 106 | 116 |
|---|---|---|---|---|---|---|---|---|---|---|---|---|
| $H_2$ | 347.96 | — | 133.15 | 367.33 | 19.65 | 367.05 | 8.58 | 215.75 | — | 0.28 | 450.95 | 18.16 |
| $H_2S$ | 0.00 | — | trace | 21.23 | 1.76 | 20.72 | 3.75 | — | 20.72 | 0.51 | 5.96 | 0.00 |
| $NH_3$ | 0.00 | — | trace | 1.83 | 0.16 | 1.76 | 0.76 | — | 1.76 | 0.07 | 0.75 | 0.00 |
| $CH_4$ | 35.26 | — | 17.94 | 49.69 | 4.02 | 49.46 | 6.19 | 29.07 | — | 0.23 | 51.26 | 2.45 |
| $C_2H_6$ | 48.71 | — | 15.78 | 44.33 | 5.24 | 43.51 | 23.14 | 25.57 | — | 0.82 | 47.41 | 2.15 |
| $C_3H_8$ | 22.27 | — | 3.68 | 10.68 | 1.66 | 10.15 | 16.31 | 5.96 | — | 0.53 | 11.84 | 0.50 |
| $C_4H_{10}$ | 0.93 | — | 0.06 | 0.19 | 0.04 | 0.16 | 0.83 | 0.10 | — | 0.02 | 0.22 | 0.01 |
| $C_5H_{12}$ | 0.93 | — | 0.02 | 0.07 | 0.02 | 0.05 | 0.90 | 0.03 | — | 0.02 | 0.09 | tr |
| $C_6H_{14}$ | 6.50 | — | 0.04 | 0.18 | 0.06 | 0.09 | 6.44 | 0.05 | — | 0.09 | 0.23 | tr |
| $N_2$ | 1.39 | — | 0.81 | 2.23 | 0.13 | 2.23 | 0.08 | 1.31 | — | tr | 2.25 | 0.11 |
| Oil | 0.00 | 100.00 | 0.01 | 3.28 | 96.72 | tr | 99.99 | — | — | 3.28 | 0.01 | 0.00 |
| Total | 463.95 | 100.00 | 171.49 | 501.04 | 129.46 | 495.16 | 166.97 | 277.84 | 22.48 | 5.85 | 570.97 | 23.38 |
| ppm S in oil | — | 21736 | — | 7793 | 7553 | — | 1268 | — | — | 7793 | — | — |
| ppm N in oil | — | 1182 | — | 432 | 748 | — | 265 | — | — | 432 | — | — |
| % aromatic C | — | 38.2 | — | 21.5 | 31.0 | — | 26.4 | — | — | 21.5 | — | — |
| Temperature ° C. | 40.3 | 84.1 | 40.0 | 366.6 | 363.6 | 40.5 | 40.5 | 40.5 | 40.5 | 40.6 | 40.6 | 40.6 |
| Pressure bar | 104.4 | 104.6 | 104.6 | 104.2 | 104.2 | 104.0 | 103.8 | 3.9 | 103.5 | 103.8 | 104.6 | 104.2 |

EXAMPLE 25

The plant of FIG. 4 is operated under adiabatic conditions, using the gas oil feedstock of Table II. There is no flow in line 102 or in line 123. The inlet temperature to reactor 108 is 326.7° C., while the exit temperature in line 142 is 368.9° C. Reactor 140 is operated with an inlet temperature of 366.9° C. and an exit temperature of 375.9° C. Of the $H_2S$ in line 142 92.72% appears in the vapour in line 118, while 7.28% appears in the stream in line 131. The results are set out in Table XXV.

TABLE XXV

| Line No. | 133 | 101 | 163 | 118 | 131 | 146 | 166 | 159 | 157 | 125 | 106 | 116 |
|---|---|---|---|---|---|---|---|---|---|---|---|---|
| $H_2$ | 347.96 | — | 134.74 | 388.82 | 19.87 | 388.52 | 8.38 | 235.41 | — | 0.30 | 478.81 | 18.37 |
| $H_2S$ | 0.00 | — | trace | 22.93 | 1.80 | 22.36 | 1.84 | — | 22.36 | 0.57 | 3.11 | 0.00 |
| $NH_3$ | 0.00 | — | trace | 2.08 | 0.17 | 2.00 | 0.38 | — | 2.00 | 0.08 | 0.40 | 0.00 |
| $CH_4$ | 35.26 | — | 16.93 | 49.05 | 3.77 | 48.81 | 5.68 | 29.58 | — | 0.24 | 50.52 | 2.31 |
| $C_2H_6$ | 48.71 | — | 15.30 | 44.98 | 5.04 | 44.12 | 21.98 | 26.73 | — | 0.86 | 47.93 | 2.09 |
| $C_3H_8$ | 22.27 | — | 3.62 | 11.07 | 1.63 | 10.50 | 15.91 | 6.36 | — | 0.57 | 12.21 | 0.50 |
| $C_4H_{10}$ | 0.93 | — | 0.06 | 0.19 | 0.04 | 0.17 | 0.83 | 0.10 | — | 0.03 | 0.22 | 0.01 |
| $C_5H_{12}$ | 0.93 | — | 0.02 | 0.07 | 0.02 | 0.05 | 0.90 | 0.03 | — | 0.02 | 0.09 | tr |
| $C_6H_{14}$ | 6.50 | — | 0.04 | 0.19 | 0.06 | 0.09 | 6.44 | 0.06 | — | 0.09 | 0.24 | tr |
| $N_2$ | 1.39 | — | 0.75 | 2.18 | 0.12 | 2.18 | 0.07 | 1.32 | — | tr | 2.19 | 0.10 |
| Oil | 0.00 | 100.00 | 0.01 | 3.55 | 96.45 | tr | 100.00 | — | — | 3.55 | 0.01 | 0.00 |
| Total | 463.95 | 100.00 | 171.49 | 525.11 | 128.97 | 518.80 | 162.41 | 299.59 | 24.36 | 6.31 | 570.97 | 23.38 |
| ppm S in oil | — | 21736 | — | 3832 | 3685 | — | 1504 | — | — | 3832 | — | — |

TABLE XXV-continued

| Line No. | 133 | 101 | 163 | 118 | 131 | 146 | 166 | 159 | 157 | 125 | 106 | 116 |
|---|---|---|---|---|---|---|---|---|---|---|---|---|
| ppm N in oil | — | 1182 | — | 307 | 521 | — | 321 | — | — | 307 | — | — |
| % aromatic C | — | 38.2 | — | 23.9 | 33.8 | — | 31.7 | — | — | 23.9 | — | — |
| Temperature ° C. | 40.3 | 84.1 | 40.0 | 368.9 | 366.2 | 40.5 | 40.5 | 40.5 | 40.5 | 40.6 | 40.4 | 40.5 |
| Pressure bar | 104.4 | 104.6 | 104.6 | 104.2 | 104.2 | 104.0 | 103.8 | 3.9 | 103.5 | 103.8 | 104.6 | 104.2 |

EXAMPLE 26

The gas oil feed of Table II is hydrotreated in a plant of the type illustrated in FIG. 2. Operation is effected under isothermal conditions with all the catalyst being at 367.8° C. The process conditions and compositions of some of the streams are set out in Table XXVI below. There is no flow in line 102 but there is a flow in line 123. 92.24% of the $H_2S$ present in line 110 appears in line 118 while only 7.76% thereof passes to line 131.

TABLE XXVI

| Line No. | 133 | 101 | 163 | 118 | 131 | 146 | 166 | 159 | 157 | 125 | 106 | 116 | 123 |
|---|---|---|---|---|---|---|---|---|---|---|---|---|---|
| $H_2$ | 347.96 | — | 133.10 | 362.31 | 19.68 | 362.04 | 8.66 | 210.78 | — | 0.27 | 427.63 | 18.15 | 0.03 |
| $H_2S$ | 0.00 | — | trace | 20.20 | 1.70 | 19.71 | 4.95 | — | 19.71 | 0.49 | 7.46 | — | 0.05 |
| $NH_3$ | 0.00 | — | trace | 1.80 | 0.16 | 1.73 | 0.87 | — | 1.73 | 0.07 | 0.82 | — | 0.01 |
| $CH_4$ | 35.26 | — | 18.14 | 49.57 | 4.07 | 49.33 | 6.54 | 28.72 | — | 0.23 | 51.14 | 2.47 | 0.03 |
| $C_2H_6$ | 48.71 | — | 15.68 | 43.46 | 5.21 | 42.66 | 23.88 | 24.83 | — | 0.81 | 46.45 | 2.14 | 0.09 |
| $C_3H_8$ | 22.27 | — | 3.62 | 10.36 | 1.64 | 9.84 | 16.54 | 5.73 | — | 0.52 | 11.45 | 0.49 | 0.06 |
| $C_4H_{10}$ | 0.93 | — | 0.06 | 0.18 | 0.04 | 0.16 | 0.84 | 0.09 | — | 0.02 | 0.21 | — | 0.00 |
| $C_5H_{12}$ | 0.93 | — | 0.02 | 0.07 | 0.02 | 0.05 | 0.90 | 0.03 | — | 0.02 | 0.08 | — | 0.00 |
| $C_6H_{14}$ | 6.50 | — | 0.03 | 0.18 | 0.06 | 0.09 | 6.44 | 0.05 | — | 0.09 | 0.22 | — | 0.01 |
| $N_2$ | 1.39 | — | 0.82 | 2.24 | 0.13 | 2.24 | 0.09 | 1.30 | — | 0.01 | 2.26 | 0.11 | 0.00 |
| Oil | 0.00 | 100.00 | 0.01 | 3.25 | 97.08 | 0.01 | 100.00 | — | — | 3.25 | 0.01 | 0.00 | 0.16 |
| Total | 463.95 | 100.00 | 171.48 | 493.62 | 129.79 | 487.86 | 169.71 | 271.53 | 21.44 | 5.78 | 547.73 | 23.36 | 0.64 |
| ppm S in oil | — | 21736 | — | 10210 | 9775 | — | 1117 | — | — | 10210 | — | — | 10210 |
| ppm N in oil | — | 1182 | — | 460 | 786 | — | 238 | — | — | 460 | — | — | 460 |
| % aromatic C | — | 38.2 | — | 23.7 | 33.8 | — | 25.2 | — | — | 23.7 | — | — | 23.7 |
| Temperature ° C. | 40.3 | 84.1 | 40.6 | 367.1 | 364.4 | 40.5 | 40.5 | 40.5 | 40.5 | 40.6 | 40.4 | 40.5 | 40.6 |
| Pressure bar | 104.4 | 104.6 | 104.6 | 104.2 | 104.2 | 104.0 | 103.8 | 3.9 | 103.5 | 103.8 | 104.6 | 104.2 | 103.8 |

EXAMPLE 27

The procedure of Example 26 is repeated except that the plant of FIG. 3 is used. Isothermal conditions are used with all the catalyst at 367.8° C. Again there is no flow in line 102 but there is a flow in line 123. The corresponding results are given in Table XXVII. 92.34% of the $H_2S$ present in line 139 appears in line 118 while only 7.66% thereof passes into line 131.

TABLE XXVII

| Line No. | 133 | 101 | 163 | 118 | 131 | 146 | 166 | 159 | 157 | 125 | 106 | 116 | 123 |
|---|---|---|---|---|---|---|---|---|---|---|---|---|---|
| $H_2$ | 347.96 | — | 132.87 | 368.66 | 19.75 | 368.36 | 8.49 | 217.37 | — | 0.30 | 470.51 | 18.12 | 0.03 |
| $H_2S$ | 0.00 | — | trace | 23.02 | 1.91 | 22.43 | 2.45 | — | 22.43 | 0.58 | 4.07 | — | 0.06 |
| $NH_3$ | 0.00 | — | trace | 2.21 | 0.19 | 2.12 | 0.51 | — | 2.12 | 0.09 | 0.53 | — | 0.01 |
| $CH_4$ | 35.26 | — | 17.93 | 49.95 | 4.04 | 49.70 | 5.93 | 29.33 | — | 0.25 | 51.51 | 2.44 | 0.03 |
| $C_2H_6$ | 48.71 | — | 15.99 | 45.21 | 5.32 | 44.33 | 22.56 | 26.16 | — | 0.88 | 48.26 | 2.18 | 0.10 |
| $C_3H_8$ | 22.27 | — | 3.77 | 11.03 | 1.71 | 10.45 | 16.10 | 6.17 | — | 0.57 | 12.16 | 0.51 | 0.06 |
| $C_4H_{10}$ | 0.91 | — | 0.06 | 0.19 | 0.04 | 0.17 | 0.83 | 0.10 | — | 0.03 | 0.22 | 0.01 | 0.00 |
| $C_5H_{12}$ | 0.93 | — | 0.02 | 0.07 | 0.02 | 0.05 | 0.90 | 0.03 | — | 0.02 | 0.09 | — | 0.00 |
| $C_6H_{14}$ | 6.50 | — | 0.03 | 0.19 | 0.06 | 0.09 | 6.44 | 0.06 | — | 0.10 | 0.24 | — | 0.01 |
| $N_2$ | 1.39 | — | 0.80 | 2.23 | 0.13 | 2.23 | 0.08 | 1.31 | — | 0.01 | 2.25 | 0.11 | 0.00 |
| Oil | 0.00 | 100.00 | 0.01 | 3.40 | 96.93 | 0.01 | 100.02 | — | — | 3.40 | 0.01 | 0.00 | 0.30 |
| Total | 463.95 | 100.00 | 171.48 | 506.16 | 130.10 | 499.94 | 164.31 | 280.53 | 24.55 | 6.23 | 589.85 | 23.37 | 0.69 |
| ppm S in oil | — | 21736 | — | 4500 | 4388 | — | 916 | — | — | 4500 | — | — | 4500 |
| ppm N in oil | — | 1182 | — | 296 | 514 | — | 226 | — | — | 296 | — | — | 296 |
| % aromatic C | — | 38.2 | — | 20.5 | 29.6 | — | 27.3 | — | — | 20.5 | — | — | 20.5 |
| Temperature ° C. | 40.3 | 84.1 | 40.6 | 367.1 | 364.3 | 40.5 | 40.5 | 40.5 | 40.5 | 40.6 | 40.4 | 40.5 | 40.6 |
| Pressure bar | 104.4 | 104.6 | 104.6 | 104.2 | 104.2 | 104.0 | 103.8 | 3.9 | 103.5 | 103.8 | 104.6 | 104.2 | 103.8 |

EXAMPLE 28

The procedure of Example 26 is repeated except that the plant of FIG. 4 is used. Isothermal conditions are used. Again there is no flow in line 102 but there is a flow in line 123. The corresponding results are given in Table XXVIII. 92.53% of the $H_2S$ in line 142 appears in line 118 while only 7.47% thereof appears in line 131.

There is no flow in line 102 but there is a flow in line 123. An inlet temperature of 326.7° C. is used to reactor 108, the exit temperature from reactor 137 being 366.3° C. The inlet temperature to reactor 140 is 366.1° C. and the exit temperature from reactor 143 is 384.6° C. The $H_2S$ in line 139 is split 92.27% to the vapour in line 118 and 7.73% in line 131. The results are set out in Table XXX.

TABLE XXVIII

| Line No. | 133 | 101 | 163 | 118 | 131 | 146 | 166 | 159 | 157 | 125 | 106 | 116 | 123 |
|---|---|---|---|---|---|---|---|---|---|---|---|---|---|
| $H_2$ | 347.96 | — | 133.63 | 378.58 | 19.76 | 378.28 | 8.39 | 226.45 | — | 0.30 | 484.41 | 18.22 | 0.03 |
| $H_2S$ | 0.00 | — | trace | 24.16 | 1.95 | 23.55 | 1.40 | — | 23.55 | 0.61 | 2.40 | — | 0.07 |
| $NH_3$ | 0.00 | — | trace | 2.45 | 0.21 | 2.36 | 0.29 | — | 2.36 | 0.10 | 0.31 | — | 0.01 |
| $CH_4$ | 35.26 | — | 17.45 | 49.65 | 3.91 | 49.40 | 5.69 | 29.57 | — | 0.24 | 51.15 | 2.38 | 0.03 |
| $C_2H_6$ | 48.71 | — | 15.77 | 45.53 | 5.22 | 44.65 | 21.99 | 26.73 | — | 0.88 | 48.51 | 2.15 | 0.10 |
| $C_3H_8$ | 22.27 | — | 3.76 | 11.22 | 1.70 | 10.64 | 15.90 | 6.37 | — | 0.58 | 12.34 | 0.51 | 0.06 |
| $C_4H_{10}$ | 0.93 | — | 0.06 | 0.20 | 0.04 | 0.17 | 0.82 | 0.10 | — | 0.03 | 0.23 | 0.01 | 0.00 |
| $C_5H_{12}$ | 0.93 | — | 0.02 | 0.08 | 0.02 | 0.05 | 0.90 | 0.03 | — | 0.02 | 0.09 | — | 0.00 |
| $C_6H_{14}$ | 6.50 | — | 0.03 | 0.19 | 0.06 | 0.10 | 6.44 | 0.06 | — | 0.10 | 0.24 | — | 0.01 |
| $N_2$ | 1.39 | — | 0.78 | 2.21 | 0.12 | 2.20 | 0.07 | 1.32 | — | 0.01 | 2.22 | 0.11 | 0.00 |
| Oil | 0.00 | 100.00 | 0.01 | 3.47 | 96.89 | 0.01 | 100.01 | — | — | 3.47 | 0.01 | 0.00 | 0.39 |
| Total | 463.95 | 100.00 | 171.49 | 517.74 | 129.88 | 511.41 | 161.90 | 290.63 | 25.91 | 6.34 | 601.91 | 23.38 | 0.70 |
| ppm S in oil | — | 21736 | — | 2038 | 1974 | — | 864 | — | — | 2038 | — | — | 2038 |
| ppm N in oil | — | 1182 | — | 195 | 336 | — | 220 | — | — | 195 | — | — | 195 |
| % aromatic C | — | 38.2 | — | 21.9 | 31.4 | — | 30.0 | — | — | 21.9 | — | — | 21.9 |
| Temperature ° C. | 40.3 | 84.1 | 40.6 | 367.0 | 364.3 | 40.5 | 40.5 | 40.5 | 40.5 | 40.6 | 40.4 | 40.5 | 40.6 |
| Pressure bar | 104.4 | 104.6 | 104.6 | 104.2 | 104.2 | 104.0 | 103.8 | 3.9 | 103.5 | 103.8 | 104.6 | 104.2 | 103.8 |

EXAMPLE 29

The same gas oil feedstock of Table II is supplied to the plant of FIG. 2, which is used under adiabatic conditions. The inlet temperature to reactor 108 is 326.7° C., the exit temperature in line 110 being 347.2° C. The inlet temperature to reactor 128 is 347.2° C., while the exit temperature in line 136 is 387.3° C. Again there is no flow in line 102 but there is a flow in line 123. 92.02% of the $H_2S$ in line 110 appears in the vapour in line 118, while only 7.98% thereof appears in line 121. The results are set out in Table XXIX.

TABLE XXIX

| Line No. | 133 | 101 | 163 | 118 | 131 | 146 | 166 | 159 | 157 | 125 | 106 | 116 | 123 |
|---|---|---|---|---|---|---|---|---|---|---|---|---|---|
| $H_2$ | 347.96 | — | 133.44 | 360.11 | 18.46 | 359.94 | 8.78 | 208.30 | — | 0.17 | 402.00 | 18.20 | 0.02 |
| $H_2S$ | 0.00 | — | trace | 17.53 | 1.52 | 17.25 | 7.09 | — | 17.25 | 0.28 | 10.04 | — | 0.03 |
| $NH_3$ | 0.00 | — | trace | 1.40 | 0.13 | 1.37 | 1.15 | — | 1.37 | 0.04 | 1.01 | — | 0.00 |
| $CH_4$ | 35.26 | — | 18.15 | 49.11 | 3.97 | 48.96 | 6.93 | 28.33 | — | 0.15 | 50.59 | 2.48 | 0.02 |
| $C_2H_6$ | 48.71 | — | 15.41 | 42.08 | 5.13 | 41.57 | 24.66 | 24.06 | — | 0.51 | 45.06 | 2.10 | 0.06 |
| $C_3H_8$ | 22.27 | — | 3.53 | 9.84 | 1.62 | 9.51 | 16.76 | 5.51 | — | 0.33 | 10.95 | 0.48 | 0.04 |
| $C_4H_{10}$ | 0.93 | — | 0.06 | 0.17 | 0.04 | 0.15 | 0.84 | 0.09 | — | 0.01 | 0.20 | 0.01 | 0.00 |
| $C_5H_{12}$ | 0.93 | — | 0.02 | 0.06 | 0.02 | 0.05 | 0.90 | 0.03 | — | 0.01 | 0.08 | — | 0.00 |
| $C_6H_{14}$ | 6.50 | — | 0.04 | 0.16 | 0.06 | 0.10 | 6.44 | 0.06 | — | 0.06 | 0.21 | — | 0.01 |
| $N_2$ | 1.19 | — | 0.83 | 2.25 | 0.12 | 2.24 | 0.09 | 1.30 | — | trace | 2.25 | 0.11 | 0.00 |
| Oil | 0.00 | 100.00 | 0.01 | 2.12 | 98.10 | 0.01 | 100.00 | — | — | 2.12 | 0.01 | 0.00 | 0.24 |
| Total | 463.95 | 100.00 | 171.49 | 484.83 | 129.17 | 481.15 | 173.64 | 267.68 | 18.62 | 3.68 | 522.40 | 23.38 | 0.41 |
| ppm S in oil | — | 21736 | — | 15300 | 14280 | — | 1381 | — | — | 15300 | — | — | 15300 |
| ppm N in oil | — | 1182 | — | 552 | 1008 | — | 267 | — | — | 552 | — | — | 552 |
| % aromatic C | — | 38.2 | — | 23.1 | 34.8 | — | 24.1 | — | — | 23.1 | — | — | 23.1 |
| Temperature ° C. | 40.3 | 84.1 | 40.6 | 346.8 | 344.3 | 40.5 | 40.5 | 40.5 | 40.5 | 40.6 | 40.4 | 40.5 | 40.6 |
| Pressure bar | 104.4 | 104.6 | 104.6 | 104.2 | 104.2 | 104.0 | 103.8 | 3.9 | 103.5 | 103.8 | 104.6 | 104.2 | 103.8 |

EXAMPLE 30

In this Example the plant of FIG. 3 is operated under adiabatic conditions using the gas oil feedstock of Table II.

TABLE XXX

| Line No. | 133 | 101 | 163 | 118 | 131 | 146 | 166 | 159 | 157 | 125 | 106 | 116 | 123 |
|---|---|---|---|---|---|---|---|---|---|---|---|---|---|
| $H_2$ | 347.96 | — | 133.13 | 367.27 | 19.67 | 367.00 | 8.58 | 215.72 | — | 0.28 | 450.91 | 18.15 | 0.03 |
| $H_2S$ | 0.00 | — | trace | 21.26 | 1.78 | 20.75 | 3.74 | — | 20.75 | 0.51 | 5.95 | — | 0.06 |
| $NH_3$ | 0.00 | — | trace | 1.83 | 0.16 | 1.76 | 0.76 | — | 1.76 | 0.07 | 0.75 | — | 0.01 |
| $CH_4$ | 35.26 | — | 17.94 | 49.69 | 4.03 | 49.46 | 6.19 | 29.07 | — | 0.23 | 51.25 | 2.45 | 0.03 |
| $C_2H_6$ | 48.71 | — | 15.79 | 44.36 | 5.26 | 43.54 | 23.12 | 25.59 | — | 0.82 | 47.38 | 2.15 | 0.09 |
| $C_3H_8$ | 22.27 | — | 3.69 | 10.71 | 1.67 | 10.18 | 16.29 | 5.98 | — | 0.53 | 11.83 | 0.50 | 0.06 |
| $C_4H_{10}$ | 0.93 | — | 0.06 | 0.19 | 0.04 | 0.16 | 0.83 | 0.10 | — | 0.02 | 0.22 | 0.01 | 0.00 |
| $C_5H_{12}$ | 0.93 | — | 0.02 | 0.07 | 0.02 | 0.05 | 0.90 | 0.03 | — | 0.02 | 0.09 | — | 0.00 |
| $C_6H_{14}$ | 6.50 | — | 0.03 | 0.18 | 0.06 | 0.09 | 6.44 | 0.05 | — | 0.09 | 0.23 | — | 0.01 |
| $N_2$ | 1.39 | — | 0.81 | 2.23 | 0.13 | 2.23 | 0.08 | 1.31 | — | trace | 2.25 | 0.11 | 0.00 |
| Oil | 0.00 | 100.00 | 0.01 | 3.24 | 97.08 | 0.01 | 99.99 | — | — | 3.24 | 0.01 | 0.00 | 0.36 |
| Total | 461.95 | 100.00 | 171.48 | 501.03 | 129.90 | 495.23 | 166.92 | 277.85 | 22.51 | 5.81 | 570.87 | 23.37 | 0.65 |
| ppm S in oil | — | 21736 | — | 7791 | 7550 | — | 1252 | — | — | 7791 | — | — | 7791 |
| ppm N in oil | — | 1182 | — | 430 | 746 | — | 265 | — | — | 430 | — | — | 430 |
| % aromatic C | — | 38.2 | — | 21.4 | 30.9 | — | 26.4 | — | — | 21.4 | — | — | 21.4 |
| Temperature ° C. | 40.3 | 84.1 | 40.6 | 346.8 | 344.3 | 40.5 | 40.5 | 40.5 | 40.5 | 40.6 | 40.4 | 40.5 | 40.6 |
| Pressure bar | 104.4 | 104.6 | 104.6 | 104.2 | 104.2 | 104.0 | 103.8 | 3.9 | 103.5 | 103.8 | 104.6 | 104.2 | 103.8 |

EXAMPLE 31

The plant of FIG. 4 is operated under adiabatic conditions, using the gas oil feedstock of Table II. There is no flow in line 102 but there is a flow in line 123. The inlet temperature to reactor 108 is 326.7° C. while the exit temperature in line 142 is 368.9° C. Reactor 143 is operated with an inlet temperature of 368.9° C. and an exit temperature of 375.9° C. Of the $H_2S$ in line 142 92.71% appears in the vapour in line 118, while 7.29% appears in the stream in line 131. The results are set out in Table XXXI.

TABLE XXXI

| Line No. | 133 | 101 | 163 | 118 | 131 | 146 | 166 | 159 | 157 | 125 | 106 | 116 | 123 |
|---|---|---|---|---|---|---|---|---|---|---|---|---|---|
| $H_2$ | 347.96 | — | 134.75 | 388.83 | 19.87 | 388.52 | 8.35 | 235.40 | — | 0.30 | 478.82 | 18.17 | 0.03 |
| $H_2S$ | 0.00 | — | trace | 22.90 | 1.8 | 22.33 | 1.81 | — | 22.33 | 0.57 | 3.07 | — | 0.06 |
| $NH_3$ | 0.00 | — | trace | 2.07 | 0.17 | 1.99 | 0.37 | — | 1.99 | 0.08 | 0.39 | — | 0.01 |
| $CH_4$ | 35.26 | — | 16.93 | 49.05 | 3.77 | 48.81 | 5.66 | 29.57 | — | 0.24 | 50.51 | 2.31 | 0.03 |
| $C_2H_6$ | 48.71 | — | 15.30 | 44.97 | 5.04 | 44.11 | 21.90 | 26.72 | — | 0.86 | 47.92 | 2.09 | 0.10 |
| $C_3H_8$ | 22.27 | — | 3.64 | 11.07 | 1.63 | 10.50 | 15.85 | 6.36 | — | 0.57 | 12.20 | 0.50 | 0.06 |
| $C_4H_{10}$ | 0.93 | — | 0.06 | 0.19 | 0.04 | 0.17 | 0.82 | 0.10 | — | 0.03 | 0.22 | 0.01 | 0.00 |
| $C_5H_{12}$ | 0.93 | — | 0.02 | 0.07 | 0.02 | 0.05 | 0.89 | 0.03 | — | 0.02 | 0.09 | — | 0.00 |
| $C_6H_{14}$ | 6.50 | — | 0.03 | 0.19 | 0.06 | 0.09 | 6.43 | 0.06 | — | 0.10 | 0.24 | — | 0.01 |
| $N_2$ | 1.39 | — | 0.75 | 2.18 | 0.12 | 2.18 | 0.07 | 1.32 | — | trace | 2.19 | 0.10 | 0.00 |
| Oil | 0.00 | 100.00 | 0.01 | 3.55 | 96.45 | 0.01 | 99.65 | — | — | 3.55 | 0.01 | 0.00 | 0.39 |
| Total | 463.95 | 100.00 | 171.49 | 525.07 | 128.97 | 518.76 | 161.80 | 299.56 | 24.32 | 6.32 | 595.66 | 23.38 | 0.70 |
| ppm S in oil | — | 21736 | — | 3833 | 3684 | — | 1496 | — | — | 3833 | — | — | 3833 |
| ppm N in oil | — | 1182 | — | 307 | 521 | — | 321 | — | — | 307 | — | — | 307 |
| % aromatic C | — | 38.2 | — | 23.9 | 33.8 | — | 31.7 | — | — | 23.9 | — | — | 23.9 |
| Temperature ° C. | 40.3 | 84.1 | 40.6 | 346.8 | 344.3 | 40.5 | 40.5 | 40.5 | 40.5 | 40.6 | 40.4 | 40.5 | 40.6 |
| Pressure bar | 104.4 | 104.6 | 104.6 | 104.2 | 104.2 | 104.0 | 103.8 | 3.9 | 103.5 | 103.8 | 104.6 | 104.2 | 103.8 |

We claim:

1. A hydrotreatment process for effecting hydrotreatment of a liquid hydrocarbon feedstock containing a mixture of liquid hydrocarbons together with organic sulphurous impurities which comprises:

(a) providing first and second hydrotreatment zones each containing a charge of a sulphided hydrotreatment catalyst;

(b) supplying to the first hydrotreatment zone the hydrocarbon feedstock and a hydrogen-containing gas;

(c) maintaining the first hydrotreatment zone under hydrotreatment conditions effective for causing hydrodesulphurisation of organic sulphurous impurities in the hydrocarbon feedstock;

(d) recovering from the first hydrotreatment zone a first intermediate product stream comprising unreacted hydrogen, hydrogen sulphide, and a mixture of hydrocarbons including a liquid first hydrocarbon fraction;

(e) contacting material of the first intermediate product stream comprising the liquid first hydrocarbon fraction in a contact zone with a first stream of desulphurised recycle gas thereby to produce (A) a vaporous mixture comprising unreacted hydrogen, hydrogen sulphide, and a second hydrocarbon fraction comprising relatively more volatile components of the mixture of hydrocarbons and (B) a third liquid hydrocarbon fraction comprising relatively less volatile components of the mixture of hydrocarbons as well as residual sulphurous impurities, the vaporous mixture and the third liquid hydrocarbon fraction being recovered as separate streams from the contact zone;

(f) supplying to the second hydrotreatment zone material of the third liquid hydrocarbon fraction of step (e) and a mixture of make-up hydrogen-containing gas and desulphurised recycle gas;

(g) maintaining the second hydrotreatment zone under hydrotreatment conditions effective for causing hydrodesulphurisation of residual sulphurous impurities in the third liquid hydrocarbon fraction;

(h) recovering from the second hydrotreatment zone a second intermediate product stream comprising unreacted hydrogen, hydrogen sulphide and a desulphurised mixture of hydrocarbons;

(i) cooling material of the vaporous mixture of step (e) to effect condensation of material of the second hydrocarbon fraction from a gaseous stream comprising unreacted hydrogen;

(j) subjecting unreacted hydrogen present in the gaseous stream of step (i) to $H_2S$ removal to form a desulphurised hydrogen-containing gas;

(k) supplying desulphurised gas of step (j) as desulphurised recycle gas to steps (e) and (f);

(l) separating from the second intermediate product stream of step (h) (AA) a fourth desulphurised hydrocarbon fraction and (BB) a gas stream containing unreacted hydrogen and hydrogen sulphide;

(m) supplying material of the gas stream of step (l) as hydrogen-containing gas to step (b); and (n) recovering as a final hydrotreated product material of at least one fraction selected from the second hydrocarbon fraction and the fourth hydrocarbon fraction.

2. A process according to claim 1, in which the contacting step (e) is effected substantially at the pressure at which the first intermediate product mixture exits the first hydrotreatment zone.

3. A process according to claim 1, in which the contacting step (e) is effected under reflux conditions using as liquid reflux stream material of the second hydrocarbon fraction condensed in step (i).

4. A process according to claim 1, in which the solid sulphided catalyst is selected from molybdenum disulphide, tungsten sulphide, cobalt sulphide, sulphided nickel-molybdate catalysts ($NiMoS_x$), a sulphided $CoO—MoO_3$/gamma-$Al_2O_3$ catalyst, and mixtures thereof.

5. A process according to claim 1, in which the hydrotreatment conditions include use of a pressure in the range of from about 15 bar to about 200 bar and of a temperature in the range of from about 220° C. to about 420° C.

6. A process according to claim 5, in which the hydrotreatment conditions include use of a pressure of from about 20 bar to about 150 bar and of a temperature of from about 230° C. to about 400° C.

7. A process according to claim 1, in which the pressure in the second hydrotreatment zone is higher than the pressure in the first hydrotreatment zone.

8. A process according to claim 7, in which hydrogen required in the process is supplied as a make-up gas stream which is compressed by means of a make-up gas compressor, and in which there is no recycle of liquid around the first or second hydrotreatment zone, and in which the pressure in the second hydrotreatment zone is maintained by means of the make-up gas compressor.

9. A process according to claim 1, in which the pressure in the second hydrotreatment zone is lower than the pressure in the first hydrotreatment zone.

10. A process according to claim 9, in which there is no recycle of liquid around the first or second hydrotreatment zone, in which the desulphurised recycle gas of step (f) is compressed by means of a gas recycle compressor, and in which the pressure in the second hydrotreatment zone is maintained by the gas recycle compressor.

11. A process according to claim 1, in which the liquid hydrocarbon feedstock to be hydrotreated in the first hydrotreatment zone is supplied thereto in the form of a liquid mixture with a compatible diluent.

12. A process according to claim 11, in which the compatible diluent comprises material of the third liquid hydrocarbon fraction.

13. A process according to claim 1, in in which the material supplied to the second hydrotreatment zone is diluted with a compatible diluent.

14. A proces according to claim 13, in which the compatible diluent comprises material of the fourth liquid hydrocarbon fraction.

15. A process according to claim 1, which further includes the steps of monitoring the sulphur content of the hydrogen-containing gas and of the liquid supplied to at least one of the hydrotreatment zones and supplying, if necessary, sulphur-containing material selected from $H_2S$, $H_2S$-containing gas and active sulphur-containing materials to that hydrotreatment zone so as to maintain the catalyst charge thereof in sulphided form.

* * * * *